US009460675B2

(12) United States Patent
Harada et al.

(10) Patent No.: US 9,460,675 B2
(45) Date of Patent: Oct. 4, 2016

(54) DISPLAY DEVICE HAVING SIGNAL PROCESSING CIRCUITS, ELECTRONIC APPARATUS HAVING DISPLAY DEVICE, DRIVING METHOD OF DISPLAY DEVICE, AND SIGNAL PROCESSING METHOD

(71) Applicant: Japan Display Inc., Tokyo (JP)

(72) Inventors: Tsutomu Harada, Tokyo (JP); Akira Sakaigawa, Tokyo (JP); Naoyuki Takasaki, Tokyo (JP); Fumitaka Goto, Tokyo (JP)

(73) Assignee: Japan Display Inc., Tokyo (JP)

( * ) Notice: Subject to any disclaimer, the term of this patent is extended or adjusted under 35 U.S.C. 154(b) by 126 days.

(21) Appl. No.: 14/198,210

(22) Filed: Mar. 5, 2014

(65) Prior Publication Data

US 2014/0292840 A1 Oct. 2, 2014

(30) Foreign Application Priority Data

Mar. 28, 2013 (JP) ..... 2013-069714

(51) Int. Cl.

| | |
|---|---|
| ***G09G 3/36*** | (2006.01) |
| ***G09G 3/34*** | (2006.01) |
| *G09G 5/06* | (2006.01) |

(52) U.S. Cl.

CPC ..... *G09G 3/3648* (2013.01); *G09G 3/3426* (2013.01); *G09G 5/06* (2013.01); *G09G 2300/0408* (2013.01); *G09G 2300/0452* (2013.01); *G09G 2320/064* (2013.01); *G09G 2320/0673* (2013.01); *G09G 2340/06* (2013.01)

(58) Field of Classification Search

CPC ..... G09G 3/3426; G09G 3/3648; G09G 5/06

USPC ..... 345/88, 694

See application file for complete search history.

(56) References Cited

U.S. PATENT DOCUMENTS

| | | | |
|---|---|---|---|
| 8,194,094 | B2 | 6/2012 | Sakaigawa et al. |
| 8,432,412 | B2 | 4/2013 | Sakaigawa et al. |

(Continued)

FOREIGN PATENT DOCUMENTS

| | | | |
|---|---|---|---|
| JP | 2010-033009 | A | 2/2010 |
| JP | 2011-154323 | A | 2/2010 |

(Continued)

OTHER PUBLICATIONS

Japanese Office Action mailed Sep. 8, 2015 for corresponding Japanese Application No. 2013-069714.

*Primary Examiner* — Jonathan Blancha

(74) *Attorney, Agent, or Firm* — Michael Best & Friedrich LLP

(57) ABSTRACT

According to an aspect, a display device includes: an image display panel; and a plurality of signal processing circuits that are responsible for respective regions in the image display panel, that convert an input value of an input HSV color space of an input signal to each of their own responsible regions into an extension value of an extended HSV color space to generate an output signal of the extension value for the image display panel. The signal processing circuits decide an extension coefficient $\alpha_A$ for the image display panel in its entirety in a cooperative manner. The signal processing circuit, regarding its own responsible region, calculates an output signal of each of a first sub-pixel, a second sub-pixel, third sub-pixel, and a fourth sub-pixel.

17 Claims, 17 Drawing Sheets

(56) References Cited

U.S. PATENT DOCUMENTS

2011/0267381 A1 11/2011 Yamazaki et al.
2012/0154454 A1* 6/2012 Ohishi ..... G09G 3/36 345/690
2012/0249404 A1* 10/2012 Sakaigawa ..... G09G 3/2003 345/88
2014/0160176 A1* 6/2014 Nose ..... G09G 3/3406 345/690

FOREIGN PATENT DOCUMENTS

JP 2011-248352 12/2011
JP 2012-128376 7/2012

* cited by examiner

DISPLAY DEVICE HAVING SIGNAL PROCESSING CIRCUITS, ELECTRONIC APPARATUS HAVING DISPLAY DEVICE, DRIVING METHOD OF DISPLAY DEVICE, AND SIGNAL PROCESSING METHOD

CROSS-REFERENCE TO RELATED APPLICATIONS

This application claims priority from Japanese Application No. 2013-069714, filed on Mar. 28, 2013, the contents of which are incorporated by reference herein in its entirety.

BACKGROUND

1. Technical Field

The present disclosure relates to a display device and a driving method thereof. The present disclosure also relates to an electronic apparatus that includes the display device. The present disclosure also relates to a signal processing method in the display device.

2. Description of the Related Art

In recent years, there has been an increasing demand for a display device for mobile apparatuses such as portable phones and electronic papers. In the display device, one pixel includes plural sub-pixels. The sub-pixels respectively output light of colors that differ from each other. One pixel can display various colors by switching ON/OFF the display of each of the sub-pixels. In some of the display devices, four sub-pixels including a white-color sub-pixel constitute one pixel (see Japanese Patent Application Laid-open Publications No. 2010-33009 (JP-A-2010-33009) and No. 2011-248352 (JP-A-2011-248352).

JP-A-2010-33009 describes a display device that includes an image display panel constituted by arraying pixels in a two-dimensional matrix, each of which is configured by first, second, third, and fourth sub-pixels, and a signal processing unit that accepts an input signal and outputs an output signal. The display device can add a fourth color to three primary colors to enlarge an HSV color space as compared to the case of the three primary colors. The signal processing unit has a maximum value Vmax(S) of brightness, where saturation S is a variable, stored therein, and obtains the saturation S and brightness V(S) based on a signal value of the input signal, and obtains an extension coefficient $\alpha$ based on at least one of values of Vmax(S)/V(S). The signal processing unit obtains an output signal value to the fourth sub-pixel based on at least respective input signal values to the first, second, and third sub-pixels, and calculates respective output signal values to the first, second, and third sub-pixels based on the input signal values, the extension coefficient $\alpha$, and the fourth output signal value.

JP-A-2011-248352 describes a display device that includes a display panel in which plural pixels are provided, each of which includes sub-pixels that respectively include red, green, and blue color filters, and a sub-pixel that controls the light transmission of a white light, a backlight unit that includes red, green, blue and white light sources, an image switching circuit that switches the display mode of the display panel between a moving-image mode and a still-image mode, and a display control circuit that controls the luminance of red, green, and blue in the backlight unit according to an image signal in the moving-image mode, and that controls the luminance of the white light source in the backlight unit according to an image signal in the still-image mode.

As described in JP-A-2010-33009 and JP-A-2011-248352, an image signal is extended corresponding to an HSV region that is expanded by one sub-pixel (basically a white sub-pixel) of plural sub-pixels based on the image signal, to reduce the light amount of the light source and reproduce a desired image. An image can be brighter without increasing the light amount of the light source.

In recent years, rapid progress has been made in increasing the resolution (increasing the number of pixels) of an image display panel. For example, a full-HD (1920×1080 pixels) image display panel is now used in smartphones, and an image display panel with resolution that exceeds the full-HD is now used in graphics tablets. As the number of pixels in the image display panel increases, a processing load to expand an HSV region and extend an image signal also increases. Therefore, there is a possibility of not being able to sufficiently respond to the increase in resolution of the image display panel.

As the number of pixels in the image display panel increases, a larger number of pins is required for a semiconductor integrated circuit that performs image processing. However, because there are manufacturing and mounting constraints on the number of pins in the semiconductor integrated circuit, there is a possibility of not being able to sufficiently respond to the increase in resolution of the image display panel.

Japanese Patent Application Laid-open Publication No. 2012-128376 (JP-A-2012-128376) describes a display device that includes a liquid crystal panel that includes plural liquid crystal pixels, plural data drive units, and plural timing controllers, wherein the liquid crystal pixels belong to any one of plural blocks, each of the data drive units corresponds to any one of the blocks, and controls the light transmission rate of the liquid crystal pixels belonging to the block, and each of the timing controllers corresponds to any one of the data drive units, acquires data of a partial image displayed on the block that corresponds to the corresponding data drive unit, and outputs control data for controlling the light transmission rate of the liquid crystal pixels belonging to the block that corresponds to the corresponding data drive unit to the corresponding data drive unit. However, in a case where the HSV region is expanded as described in JP-A-2010-33009 and JP-A-2011-248352, it is preferable to expand the HSV region taking into account the entire pixels included in the liquid crystal panel. However, this point is not described in JP-A-2012-128376.

For the foregoing reasons, there is a need for a display device, an electronic apparatus, a driving method of the display device, a signal processing method, and a signal processing circuit capable of responding to the increase in resolution of an image display panel.

SUMMARY

According to an aspect, a display device includes: an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color; and a plurality of signal processing circuits that are responsible for respective regions in the image display panel, that convert an input value of an input HSV color space of an input signal to each of their own responsible regions into an extension value of an extended HSV color space that is extended by the first color, the second color, the third color, and the fourth color to generate an output signal of the extension value, and that output the generated output signal to the image display panel. The signal processing circuits decide an extension coefficient $\alpha_A$ for the image display panel in its entirety in a cooperative manner. The signal processing circuit, regarding its own responsible region, calculates an output signal of the first sub-pixel based on at least an input signal of the first sub-pixel and the extension coefficient $\alpha_A$, and outputs the output signal to the first sub-pixel, calculates an output signal of the second sub-pixel based on at least an input signal of the second sub-pixel and the extension coefficient $\alpha_A$, and outputs the output signal to the second sub-pixel, calculates an output signal of the third sub-pixel based on at least an input signal of the third sub-pixel and the extension coefficient $\alpha_A$, and outputs the output signal to the third sub-pixel, and calculates an output signal of the fourth sub-pixel based on the input signal of the first sub-pixel, the input signal of the second sub-pixel, and the input signal of the third sub-pixel, and outputs the output signal to the fourth sub-pixel.

According to another aspect, an electronic apparatus includes: the display device; and a control device that supplies the input signal to the display device.

According to another aspect, a driving method is for a display device that includes an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color, and a plurality of signal processing circuits that are responsible for respective regions in the image display panel, that convert an input value of an input HSV color space of an input signal to each of their own responsible regions into an extension value of an extended HSV color space that is extended by the first color, the second color, the third color, and the fourth color to generate an output signal of the extension value, and that output the generated output signal to the image display panel. The driving method includes: deciding an extension coefficient $\alpha_A$ for the image display panel in its entirety by the signal processing circuits in a cooperative manner; and by the signal processing circuit, regarding its own responsible region, calculating an output signal of the first sub-pixel based on at least an input signal of the first sub-pixel and the extension coefficient $\alpha_A$, and outputting the output signal to the first sub-pixel, calculating an output signal of the second sub-pixel based on at least an input signal of the second sub-pixel and the extension coefficient $\alpha_A$, and outputting the output signal to the second sub-pixel, calculating an output signal of the third sub-pixel based on at least an input signal of the third sub-pixel and the extension coefficient $\alpha_A$, and outputting the output signal to the third sub-pixel, and calculating an output signal of the fourth sub-pixel based on the input signal of the first sub-pixel, the input signal of the second sub-pixel, and the input signal of the third sub-pixel, and outputting the output signal to the fourth sub-pixel.

According to another aspect, a signal processing method is for a display device that includes an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color, and a plurality of signal processing circuits that are responsible for respective regions in the image display panel, that convert an input value of an input HSV color space of an input signal to each of their own responsible regions into an extension value of an extended HSV color space that is extended by the first color, the second color, the third color, and the fourth color to generate an output signal of the extension value, and that output the generated output signal to the image display panel. The signal processing method is executed by the signal processing circuits. The signal processing method includes: deciding an extension coefficient $\alpha_A$ for the image display panel in its entirety by the signal processing circuits in a cooperative manner; and by the signal processing circuit, regarding its own responsible region, calculating an output signal of the first sub-pixel based on at least an input signal of the first sub-pixel and the extension coefficient $\alpha_A$, and outputting the output signal to the first sub-pixel, calculating an output signal of the second sub-pixel based on at least an input signal of the second sub-pixel and the extension coefficient $\alpha_A$, and outputting the output signal to the second sub-pixel, calculating an output signal of the third sub-pixel based on at least an input signal of the third sub-pixel and the extension coefficient $\alpha_A$, and outputting the output signal to the third sub-pixel, and calculating an output signal of the fourth sub-pixel based on the input signal of the first sub-pixel, the input signal of the second sub-pixel, and the input signal of the third sub-pixel, and outputting the output signal to the fourth sub-pixel.

According to another aspect, a signal processing circuit is responsible for one of a plurality of regions in an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color. The signal processing circuit converts an input value of an input HSV color space of an input signal to its own responsible region into an extension value of an extended HSV color space that is extended by the first color, the second color, the third color, and the fourth color to generate an output signal of the extension value. The signal processing circuit outputs the generated output signal to the image display panel. The signal processing circuit decides an extension coefficient $\alpha_A$ for the image display panel in its entirety in a cooperative manner with other signal processing circuits that are responsible for other regions of the regions, and the signal processing circuit, regarding its own responsible region, calculates an output signal of the first sub-pixel based on at least an input signal of the first sub-pixel and the extension coefficient $\alpha_A$, and outputs the output signal to the first sub-pixel, calculates an output signal of the second sub-pixel based on at least an input signal of the second sub-pixel and the extension coefficient $\alpha_A$, and outputs the output signal to the second sub-pixel, calculates an output signal of the third sub-pixel based on at least an input signal of the third sub-pixel and the extension coefficient $\alpha_A$, and outputs the output signal to the third sub-pixel, and calculates an output signal of the fourth sub-pixel based on the input signal of the first sub-pixel, the input signal of the second sub-pixel, and the input signal of the third sub-pixel, and outputs the output signal to the fourth sub-pixel.

DETAILED DESCRIPTION

Hereinafter, an example of implementing a technology of the present disclosure will be described in detail with reference to the accompanying drawings. Explanations are given in the following order.

1. Embodiment (Display Device, Electronic Apparatus, Driving Method of Display Device, and Signal Processing Method)

One pixel includes a white-color sub-pixel

Calculate an extension coefficient of each region based on an input signal

Decide an extension coefficient of the entire image display panel

Generate output signal based on the extension coefficient of the entire image display panel 2. Application Examples (Electronic Apparatus)

Examples in which a display device according to the embodiment is applied to an electronic apparatus 3. Aspects of the Present Disclosure

1. Embodiment

Figure 1:
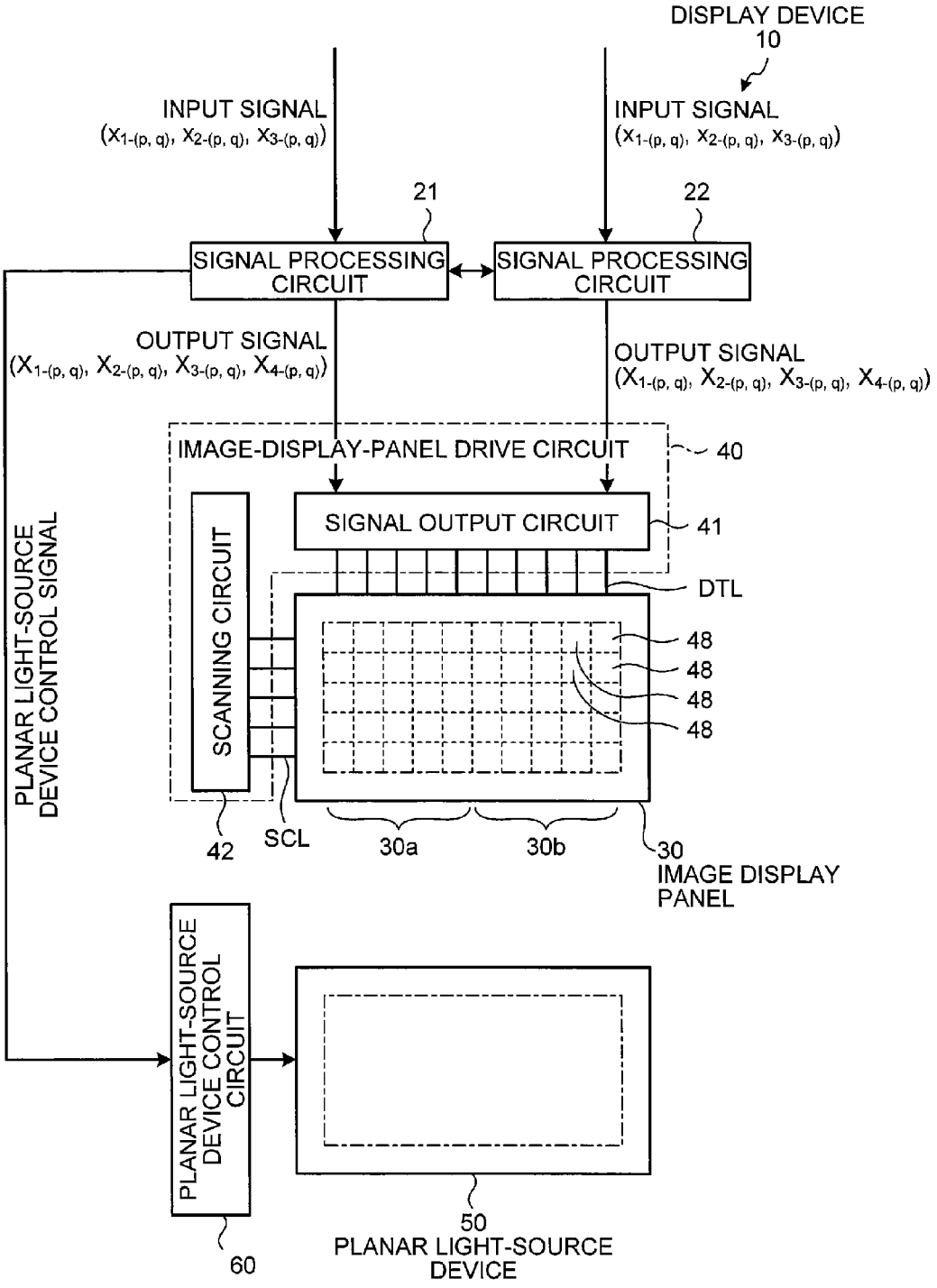
FIG. 1 is a block diagram of a configuration example of a display device according to an embodiment of the present disclosure.
Figure 2:
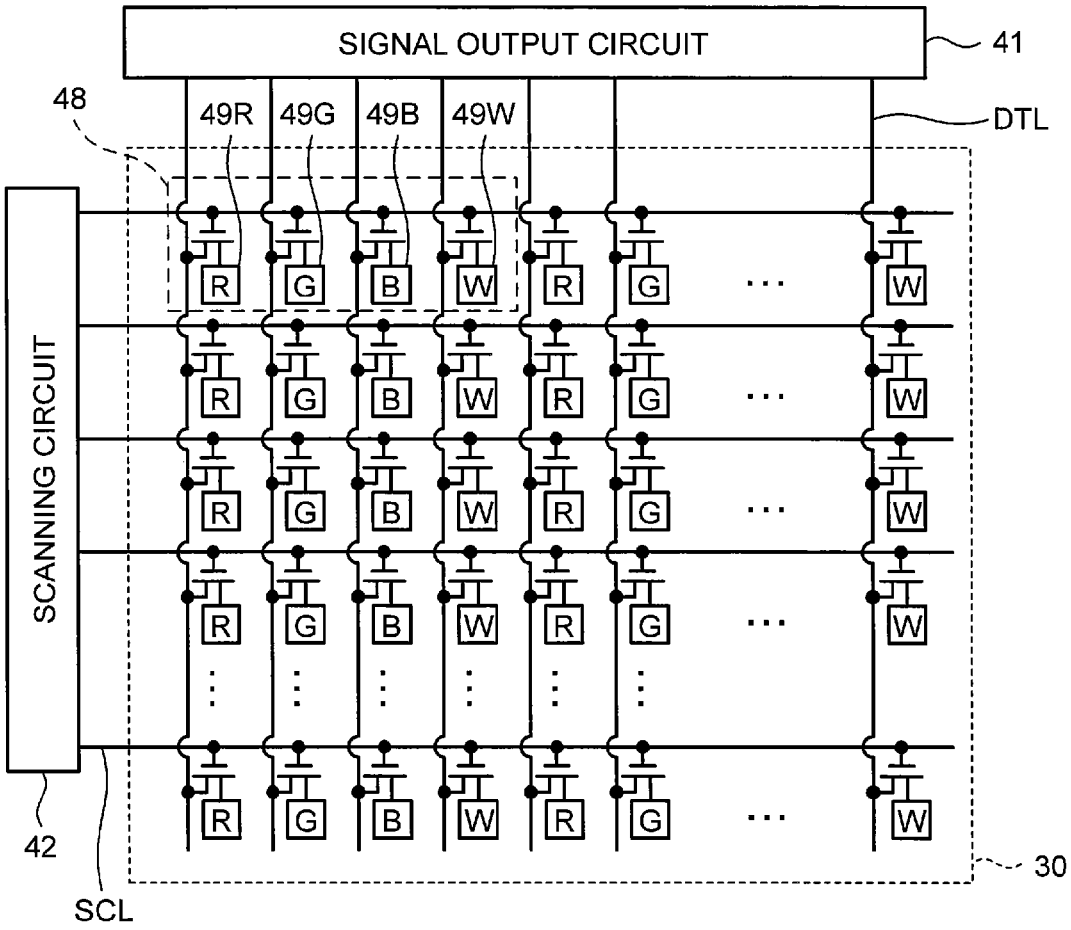
FIG. 2 is a conceptual diagram of an image display panel and an image-display-panel drive circuit in the display device illustrated in FIG. 1.

FIG. 1 is a block diagram of a configuration example of a display device according to an embodiment of the present disclosure. FIG. 2 is a conceptual diagram of an image display panel and an image-display-panel drive circuit in the display device illustrated in FIG. 1. As illustrated in FIG. 1, a display device 10 according to the embodiment includes signal processing circuits 21 and 22 that transmit a signal to each unit of the display device 10 to control an operation of each unit, an image display panel 30 that displays an image based on an output signal output from the signal processing circuits 21 and 22, an image-display-panel drive circuit 40 that controls driving of the image display panel 30, a planar light-source device 50 that illuminates the image display panel 30 from its backside, and a planar light-source device control circuit 60 that controls driving of the planar light-source device 50. The display device 10 has the same configuration as an image display device assembly described in Japanese Patent Application Laid-open Publication No. 2011-154323 (JP-A-2011-154323), and various modifications described in JP-A-2011-154323 are applicable to the display device 10.

As illustrated in FIG. 2, in the image display panel 30, pixels 48 are arrayed in a two-dimensional matrix, where the number of the pixels 48 is $P_0 \times Q_0$ (the number of the pixels 48 in the horizontal direction is $P_0$ and the number of the pixels 48 in the vertical direction is $Q_0$). Each of the pixels 48 includes a first sub-pixel 49R that displays a first primary color (for example, red), a second sub-pixel 49G that displays a second primary color (for example, green), a third sub-pixel 49B that displays a third primary color (for example, blue), and a fourth sub-pixel 49W that displays a fourth color (specifically, white).

More specifically, the display device according to the embodiment is a transmissive color liquid crystal display device. The image display panel 30 is a color liquid crystal display panel, in which a first color filter that passes the first primary color is arranged between the first sub-pixel 49R and an image viewer, a second color filter that passes the second primary color is arranged between the second sub-pixel 49G and the image viewer, and a third color filter that passes the third primary color is arranged between the third sub-pixel 49B and the image viewer. In the image display panel 30, no color filter is arranged between the fourth sub-pixel 49W and the image viewer. The fourth sub-pixel 49W can be provided with a transparent resin layer instead of the color filter. By providing the transparent resin layer as described above, the image display panel 30 can prevent generating a sharp step on the fourth sub-pixel 49W due to the absence of the color filter in the fourth sub-pixel 49W.

In an example illustrated in FIG. 2, in the image display panel 30, the first sub-pixel 49R, the second sub-pixel 49G, the third sub-pixel 49B, and the fourth sub-pixel 49W are arranged in an array similar to a stripe array. The configuration and arrangement of sub-pixels included in one pixel are not particularly limited. In the image display panel 30, the first sub-pixel 49R, the second sub-pixel 49G, the third sub-pixel 49B, and the fourth sub-pixel 49W can also be arranged in an array similar to a diagonal array (a mosaic array). For example, an array similar to a delta array (a triangle array), an array similar to a rectangle array, or the like can also be employed. Generally, the array similar to the stripe array is preferable for personal computers and the like to display data and text. In contrast thereto, the array similar to the mosaic array is preferable for video camera recorders, digital still cameras, and the like to display natural images.

Referring back to FIG. 1, the signal processing circuits 21 and 22 are arithmetic processing circuits that control an operation of each of the image display panel 30 and the planar light-source device 50.

The signal processing circuit 21 is responsible for the processing of a region 30*a* on the left side of plural pixels 48 in the image display panel 30 illustrated in FIG. 1, where in the region 30*a*, the number of pixels 48 is $I \times Q_0$ (the number of pixels 48 in the horizontal direction is I (where $1 \leq I < P_0$) and the number of pixels 48 in the vertical direction is $Q_0$). The signal processing circuit 22 is responsible for the processing of a region 30*b* on the right side of plural pixels 48 in the image display panel 30 illustrated in FIG. 1, where in the region 30*b*, the number of pixels 48 is $(P_0-I) \times Q_0$ (the number of pixels 48 in the horizontal direction is $(P_0-I)$ and the number of pixels 48 in the vertical direction is $Q_0$).

Figure 3:
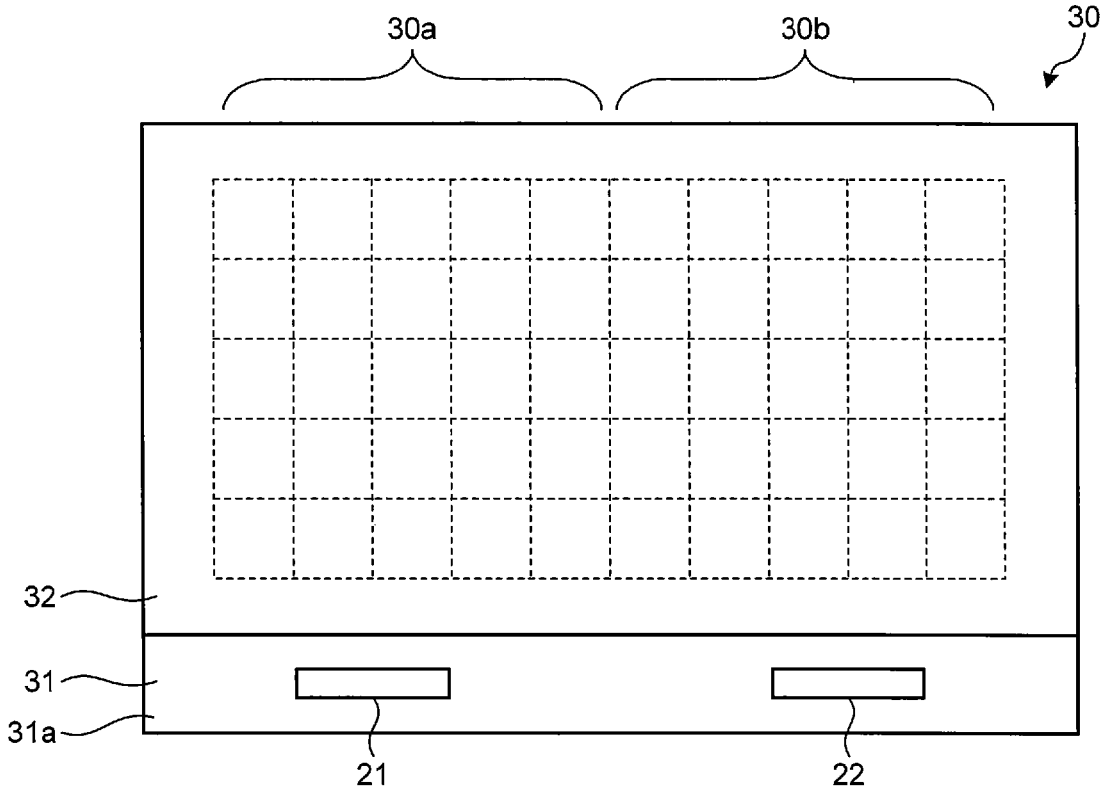
FIG. 3 is a schematic plan view of the image display panel.

Each of the signal processing circuits 21 and 22 is a semiconductor integrated circuit (a semiconductor chip) that is a COG (chip on glass), for example. FIG. 3 is a schematic plan view of the image display panel. The image display panel 30 includes a TFT substrate 31 on which a TFT (thin film transistor) element and the like are formed, and a counter substrate 32 that is arranged to be opposed to the main surface of the TFT substrate 31. A liquid crystal is filled between the TFT substrate 31 and the counter substrate 32. The TFT substrate 31 includes a region 31*a* that does not overlap with the counter substrate 32 as viewed from a direction perpendicular to the main surface of the TFT substrate 31. The signal processing circuits 21 and 22 that are the COGs are mounted on the region 31*a*.

As described above, the display device 10 includes the signal processing circuit 21 that is responsible for the processing of the region 30*a*, and the signal processing circuit 22 that is responsible for the processing of the region 30*b*. Therefore, the display device 10 can respond to the increase in resolution of an image display panel, even in a case where there is a constraint on the number of pins in a semiconductor chip.

Referring back to FIG. 1, the signal processing circuit 21 is coupled to the signal processing circuit 22, the image-display-panel drive circuit 40, and the planar light-source device control circuit 60. The signal processing circuit 22 is coupled to the signal processing circuit 21 and the image-display-panel drive circuit 40.

The signal processing circuit 21 and the signal processing circuit 22 cooperate with each other. More specifically, the signal processing circuit 21 operates as a master of the signal processing circuit 22, and the signal processing circuit 22 operates as a slave of the signal processing circuit 21.

The signal processing circuit 21 processes an input signal input from an external application processor (a host CPU (not illustrated)) to generate an output signal and a planar light-source device control signal. The signal processing circuit 22 processes an input signal input from the external application processor to generate an output signal. That is, the signal processing circuits 21 and 22 convert an input value (an input signal) of an input HSV color space in the input signal into an extension value (an output signal) of an extended HSV color space that is extended by a first color, a second color, a third color, and a fourth color, and generate the output signal. The signal processing circuits 21 and 22 then output the generated output signal to the image-display-panel drive circuit 40. The signal processing circuit 21 outputs the generated planar light-source device control signal to the planar light-source device control circuit 60.

Figure 4:
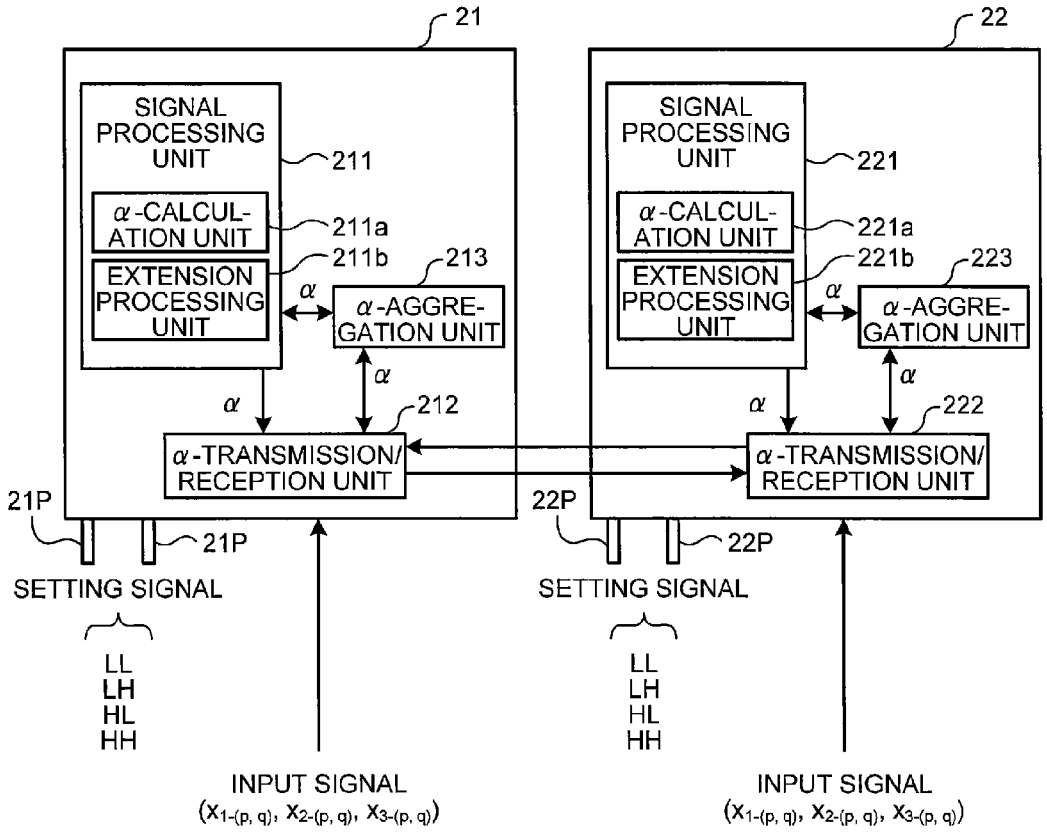
FIG. 4 illustrates an outline of an internal configuration of a signal processing circuit.

FIG. 4 illustrates an outline of an internal configuration of the signal processing circuit. As illustrated in FIG. 4, the signal processing circuit 21 includes a signal processing unit 211, an α-transmission/reception unit 212, and an α-aggregation unit 213. The signal processing unit 211 includes an α-calculation unit 211*a* and an extension processing unit 211*b*.

The signal processing circuit 22 includes a signal processing unit 221, an α-transmission/reception unit 222, and an α-aggregation unit 223. The signal processing unit 221 includes an α-calculation unit 221*a* and an extension processing unit 221*b*.

As described above, the signal processing circuits 21 and 22 have the same circuit configuration. That is, the signal processing circuits 21 and 22 are manufactured using the same mask through the same manufacturing steps. In the embodiment, the signal processing circuit 21 operates as a master of the signal processing circuit 22, and the signal processing circuit 22 operates as a slave of the signal processing circuit 21. Whether the signal processing circuits 21 and 22 operate as a master or a slave is set by a setting signal with at least a 1-bit width (a 2-bit width in the embodiment), which is input to the signal processing circuits 21 and 22.

The signal processing circuit 21 includes at least one (two in the embodiment) setting-signal input terminal (input pin) 21P. The signal processing circuit 22 includes at least one (two in the embodiment) setting-signal input terminal (input pin) 22P. The signal processing circuits 21 and 22 operate as a master when an "LL (L means low level)" setting signal is input, operate as a first slave when an "LH (H means high level)" setting signal is input, operate as a second slave when an "HL" setting signal is input, and operate as a third slave when an "HH" setting signal is input. In a case where the setting signal has an n-bit width (n is a natural number), the display device 10 can include slaves, where the number of the slaves is up to $(2^n-1)$.

The maximum number of slaves can be restricted in advance because it is necessary to specify the communication time and the communication timing. The number of slaves to be coupled can also be set for a master.

As described above, the signal processing circuits 21 and 22 have the same circuit configuration, and therefore design costs and manufacturing costs can be reduced as compared to the case where a master signal processing circuit and a slave signal processing circuit are separately designed and manufactured.

A low-level signal can be input to the signal processing circuits 21 and 22 by coupling a ground (GND) line and a setting-signal input terminal. A high-level signal can be input to the signal processing circuits 21 and 22 by coupling a power supply (VDD) line and the setting-signal input terminal. Therefore, the signal processing circuits 21 and 22 can set an operating mode easily and reliably.

In the embodiment, each of the signal processing circuits 21 and 22 includes the setting-signal input terminal to input a setting signal to the setting-signal input terminal. However, each of the signal processing circuits 21 and 22 can have a mode-setting register incorporated therein, and can operate as a master or a slave according to a setting signal (a mode value) input (written) to the register from the external application processor when initialization processing is performed at the time of power-on. Therefore, the operating mode of the signal processing circuits 21 and 22 can be set by software, and can flexibly respond to changes in the specifications and the like.

The α-calculation unit 211*a* in the signal processing circuit 21 calculates an extension coefficient for the region 30*a*. Hereinafter, the extension coefficient calculated by the α-calculation unit 211*a* is sometimes referred to as "$\alpha_1$". The α-calculation unit 211*a* also calculates $1/\alpha_1$. The extension-coefficient calculation processing is described later.

The α-calculation unit 221*a* in the signal processing circuit 22 calculates an extension coefficient for the region 30*b*. Hereinafter, the extension coefficient calculated by the α-calculation unit 221*a* is sometimes referred to as "$\alpha_2$". The α-calculation unit 221*a* also calculates $1/\alpha_2$.

The α-transmission/reception unit 222 in the signal processing circuit 22 transmits the extension coefficient $\alpha_2$ calculated by the α-calculation unit 221*a* to the α-transmission/reception unit 212 in the signal processing circuit 21. The α-transmission/reception unit 222 can also transmit $1/\alpha_2$ calculated by the α-calculation unit 221*a* to the α-transmission/reception unit 212. Because a high processing load is required to compute $1/\alpha_2$ (reciprocal computation), the α-transmission/reception unit 222 transmits $1/\alpha_2$ calculated by the α-calculation unit 221*a* to the α-transmission/reception unit 212, and therefore a processing load imposed on the signal processing circuit 21 can be reduced. This is more effective when the number of signal processing circuits that operate as a slave increases.

Assuming that the bit width of the extension coefficient $\alpha_2$ is 10 bits, and the bit width of $1/\alpha_2$ is 10 bits, the data amount to be transmitted from the signal processing circuit 22 to the signal processing circuit 21 is 20 bits, which is very small.

The α-transmission/reception unit 212 in the signal processing circuit 21 receives the extension coefficient $\alpha_2$ from the α-transmission/reception unit 222, and outputs the extension coefficient $\alpha_2$ to the α-aggregation unit 213.

The α-aggregation unit 213 in the signal processing circuit 21 aggregates the extension coefficient $\alpha_1$ calculated by the α-calculation unit 211*a*, and the extension coefficient $\alpha_2$ received by the α-transmission/reception unit 212 to decide an extension coefficient α of the image display panel 30 in its entirety. Hereinafter, the extension coefficient decided by the α-aggregation unit 213 is sometimes referred to as "$\alpha_A$". The α-aggregation unit 213 also decides $1/\alpha_A$.

The α-transmission/reception unit 212 in the signal processing circuit 21 transmits the extension coefficient $\alpha_A$ decided by the α-aggregation unit 213 to the α-transmission/reception unit 222 in the signal processing circuit 22. The α-transmission/reception unit 212 can also transmit $1/\alpha_A$ decided by the α-aggregation unit 213 to the α-transmission/reception unit 222. Because a high processing load is required to compute $1/\alpha_A$ (reciprocal computation), the α-transmission/reception unit 212 transmits $1/\alpha_A$ decided by the α-aggregation unit 213 to the α-transmission/reception unit 222, and therefore a processing load imposed on the signal processing circuit 22 can be reduced.

Assuming that the bit width of the extension coefficient $\alpha_A$ is 10 bits, and the bit width of $1/\alpha_A$ is 10 bits, the data amount to be transmitted from the signal processing circuit 21 to the signal processing circuit 22 is 20 bits, which is very small.

The extension processing unit 211*b* in the signal processing circuit 21 uses the extension coefficient $\alpha_A$ decided by the α-aggregation unit 213 to perform the extension processing on the region 30*a*. The extension processing unit 221*b* in the signal processing circuit 22 uses the extension coefficient $\alpha_A$ received by the α-transmission/reception unit 222 to perform the extension processing on the region 30*b*. The extension processing is described later.

The α-aggregation unit 223 in the signal processing circuit 22 operates when the signal processing circuit 22 operates as a master, but does not operate when the signal processing circuit 22 operates as a slave. At this time, by shutting off power supply to the α-aggregation unit 223, the display device 10 can reduce power consumption.

Referring back to FIGS. 1 and 2, the image-display-panel drive circuit 40 includes a signal output circuit 41 and a scanning circuit 42. In the image-display-panel drive circuit 40, the signal output circuit 41 holds therein video signals to sequentially output the video signals to the image display panel 30. The signal output circuit 41 is electrically coupled to the image display panel 30 by a wiring DTL. In the image-display-panel drive circuit 40, the scanning circuit 42 controls ON/OFF of a switching element (for example, a TFT) that controls an operation (the light transmission rate) of a sub-pixel in the image display panel 30. The scanning circuit 42 is electrically coupled to the image display panel 30 by a wiring SCL.

The planar light-source device 50 is arranged at the backside of the image display panel 30, and irradiates light toward the image display panel 30 to illuminate the image display panel 30. The planar light-source device 50 irradiates light on the entire surface of the image display panel 30 to make the image display panel 30 brighter.

The planar light-source device control circuit 60 controls the amount of light to be output from the planar light-source device 50, and the like. Specifically, based on a planar light-source device control signal that is output from the signal processing circuit 21, the planar light-source device control circuit 60 adjusts the voltage to be supplied to the planar light-source device 50, and the like by PWM (pulse width modulation) or the like to control the amount of light (the light intensity) irradiated on the image display panel 30.

Figure 5:
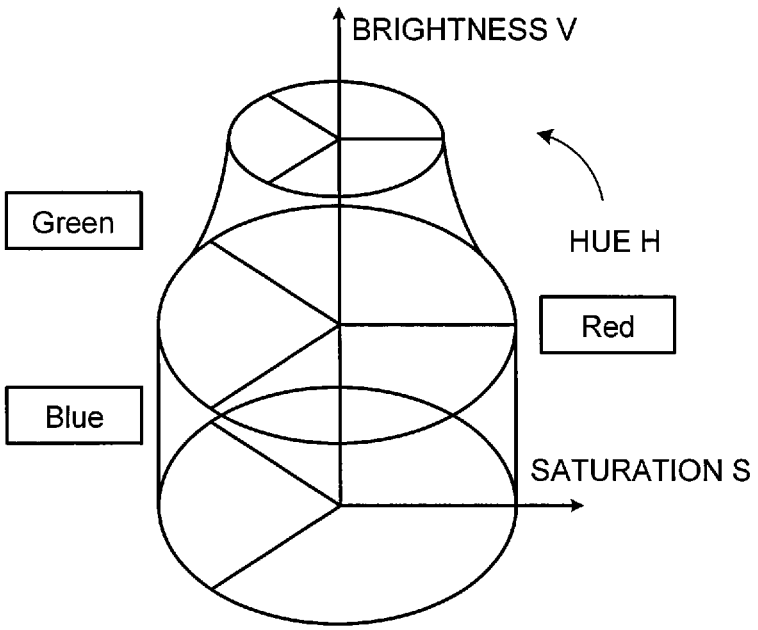
FIG. 5 is a conceptual diagram of an extended HSV color space that is extendable by the display device according to the embodiment.
Figure 6:
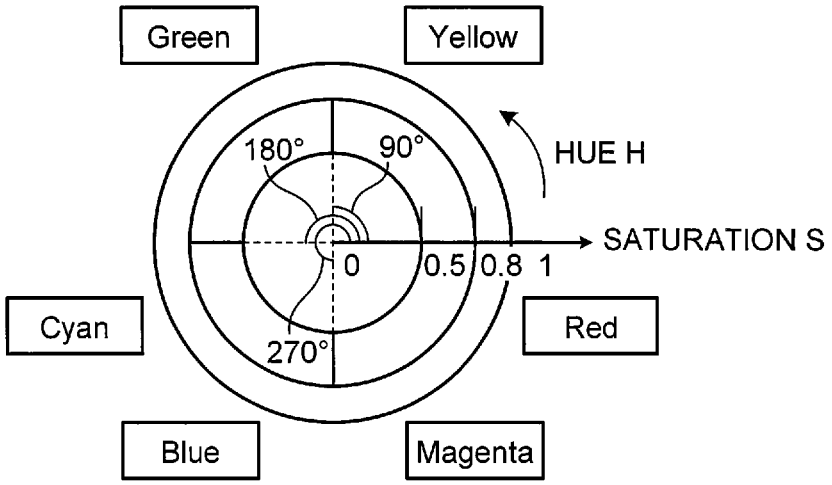
FIG. 6 is a conceptual diagram illustrating a relationship between hue and saturation in an extended HSV color space.
Figure 7:
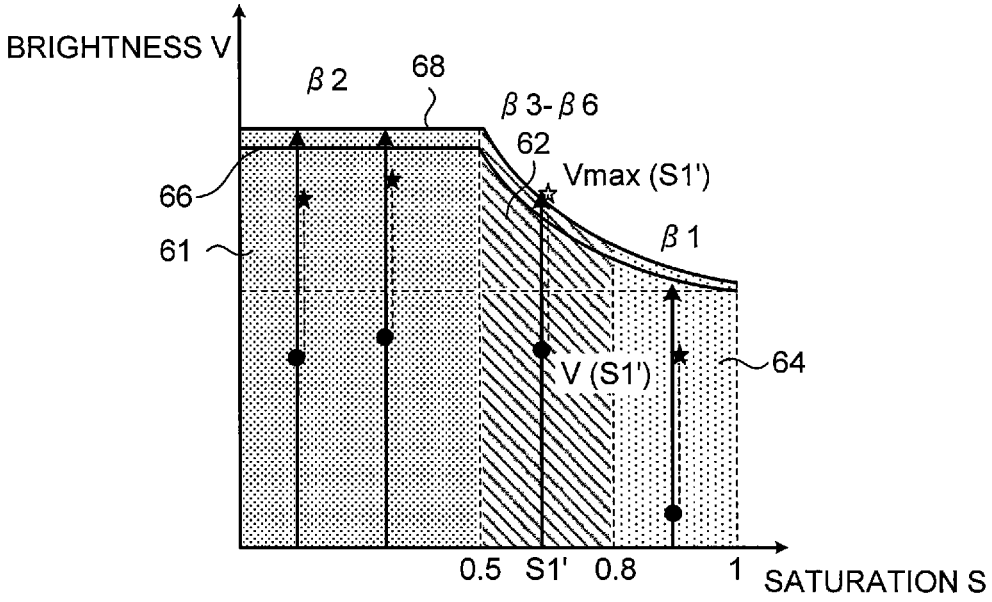
FIG. 7 is a conceptual diagram illustrating a relationship between saturation and brightness in an extended HSV color space.
Figure 8:
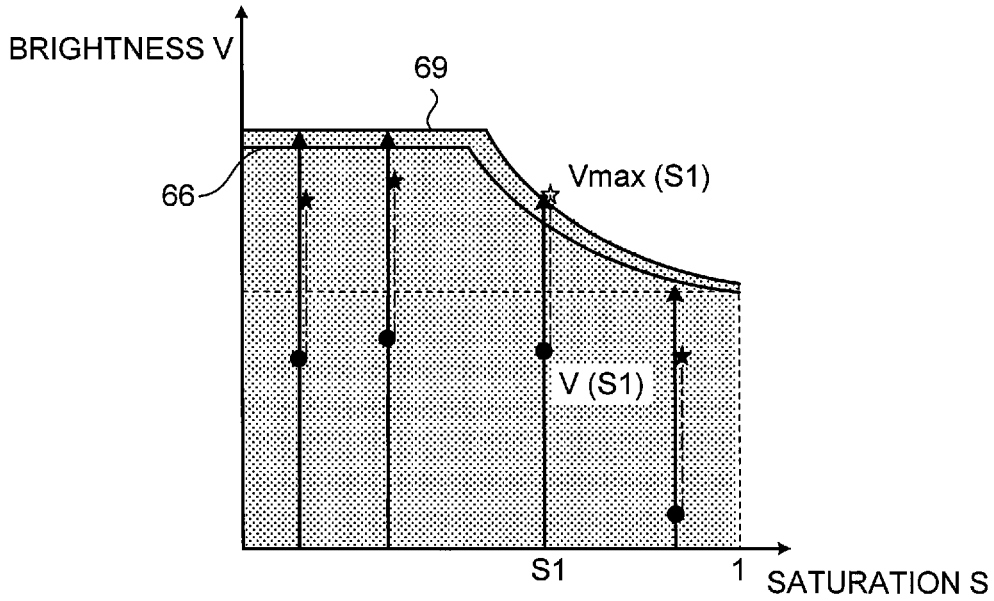
FIG. 8 is a conceptual diagram illustrating a relationship between saturation and brightness in an extended HSV color space that is not divided.

Next, a processing operation performed by the signal processing circuits 21 and 22 is explained with reference to FIGS. 5 to 8. FIG. 5 is a conceptual diagram of an extended HSV color space that is extendable by the display device according to the present embodiment. FIG. 6 is a conceptual diagram illustrating a relationship between hue and saturation in the extended HSV color space. FIG. 7 is a conceptual diagram illustrating a relationship between saturation and brightness in the extended HSV color space. FIG. 8 is a conceptual diagram illustrating a relationship between saturation and brightness in an extended HSV color space that is not divided.

An input signal that is display image information is input from an external application processor to the signal processing circuit 21. The input signal includes information for each pixel regarding an image (a color) to be displayed at the position of the pixel. Specifically, signals for the (p,q)th pixel (where and $1 \le p \le I$ and $1 \le q \le Q_0$), including a first sub-pixel input signal with a signal value of $x_{1-(p,q)}$, a second sub-pixel input signal with signal value of $x_{2-(p,q)}$, and a third sub-pixel input signal with a signal value of $x_{3-(p,q)}$, are input to the signal processing circuit 21.

Similarly, an input signal that is display image information is input from an external application processor to the signal processing circuit 22. The input signal includes information for each pixel regarding an image (a color) to be displayed at the position of the pixel. Specifically, signals for the (p,q)th pixel (where $I < p \le P_0$ and $1 \le q \le Q_0$), including a first sub-pixel input signal with the signal value of $x_{1-(p,q)}$, a second sub-pixel input signal with the signal value of $x_{2-(p,q)}$, and a third sub-pixel input signal with the signal value of $x_{3-(p,q)}$, are input to the signal processing circuit 22.

The signal processing circuits 21 and 22 process the input signals to generate a first sub-pixel output signal (a signal value $X_{1-(p,q)}$) for deciding display gradation of the first sub-pixel 49R, a second sub-pixel output signal (a signal value $X_{2-(p,q)}$) for deciding display gradation of the second sub-pixel 49G, a third sub-pixel output signal (a signal Value $X_{3-(p,q)}$) for deciding display gradation of the third sub-pixel 49B, and a fourth sub-pixel output signal (a signal value $X_{4-(p,q)}$) for deciding display gradation of the fourth sub-pixel 49W, and to output these output signals to the image-display-panel drive circuit 40.

The display device 10 includes the fourth sub-pixel 49W that outputs a fourth color (white) to the pixel 48 to expand the dynamic range of brightness in an HSV color space (an extended HSV color space) as illustrated in FIG. 5. That is, as illustrated in FIG. 5, a three-dimensional body is placed on a cylindrical-shaped HSV color space that can be displayed by the first sub-pixel, the second sub-pixel, and the third sub-pixel, and the three-dimensional body has a substantially trapezoidal shape with its oblique side being curved in a cross section that includes the saturation axis and the brightness axis, where as the saturation becomes higher, the maximum value of the brightness becomes smaller. A maximum value Vmax(S) of brightness, where saturation S in the HSV color space enlarged by adding the fourth color (white) is a variable, is stored in the signal processing circuits 21 and 22. That is, the signal processing circuits 21 and 22 store therein the maximum value Vmax(S) of brightness for each coordinates (values) of the saturation and the hue for the three-dimensional shape of the HSV color space illustrated in FIG. 5. Because the input signal is constituted by the input signals of the first sub-pixel 49R, the second sub-pixel 49G; and the third sub-pixel 49B, an HSV color space of the input signal has a cylindrical shape, that is, has the same shape as a cylindrical-shaped portion of the extended HSV color space.

Next, the signal processing circuits 21 and 22 calculate the first sub-pixel output signal (the signal value $X_{1-(p,q)}$) based on at least the first sub-pixel input signal (the signal value $x_{1-(p,q)}$) and the extension coefficient $\alpha_A$, and outputs the first sub-pixel output signal to the first sub-pixel 49R. The signal processing circuits 21 and 22 calculate the second sub-pixel output signal (the signal value $X_{2-(p,q)}$) based on at least the second sub-pixel input signal (the signal value $x_{2-(p,q)}$) and the extension coefficient $\alpha_A$, and outputs the second sub-pixel output signal to the second sub-pixel 49G. The signal processing circuits 21 and 22 calculate the third sub-pixel output signal (the signal value $X_{3-(p,q)}$) based on at least the third sub-pixel input signal (the signal value $x_{3-(p,q)}$) and the extension coefficient $\alpha_A$, and outputs the third sub-pixel output signal to the third sub-pixel 49B. The signal processing circuits 21 and 22 calculate the fourth sub-pixel output signal (the signal value $X_{4-(p,q)}$) based on the first sub-pixel input signal (the signal value $x_{1-(p,q)}$), the second sub-pixel input signal (the signal value $x_{2-(p,q)}$), and the third sub-pixel input signal (the signal value $x_{3-(p,q)}$), and outputs the fourth sub-pixel output signal to the fourth sub-pixel 49W.

Specifically, the first sub-pixel output signal is calculated based on the first sub-pixel input signal, the extension coefficient $\alpha_A$, and the fourth sub-pixel output signal. Also, the second sub-pixel output signal is calculated based on the second sub-pixel input signal, the extension coefficient $\alpha_A$, and the fourth sub-pixel output signal. Also, the third sub-pixel output signal is calculated based on the third sub-pixel input signal, the extension coefficient $\alpha_A$, and the fourth sub-pixel output signal.

That is, when $\chi$ is a constant dependent on a display device, the signal processing circuits 21 and 22 obtain the first sub-pixel output signal value $X_{1-(p,q)}$, the second sub-pixel output signal value. $X_{2-(p,q)}$, and the third sub-pixel output signal value $X_{3-(p,q)}$ for the (p,q)th pixel (or a set of the first sub-pixel 49R, the second sub-pixel 49G, and the third sub-pixel 49B) from the following equations, respectively.

$$X_{1-(p,q)}=\alpha_A \cdot x_{1-(p,q)}-\chi \cdot X_{4-(p,q)}$$

$$X_{2-(p,q)}=\alpha_A \cdot x_{2-(p,q)}-\chi \cdot X_{4-(p,q)}$$

$$X_{3-(p,q)}=\alpha_A \cdot x_{3-(p,q)}-\chi \cdot X_{4-(p,q)}$$

The signal processing circuit 21 obtains the maximum value Vmax(S) of brightness, where the saturation S in the HSV color space enlarged by adding the fourth color is a variable, obtains the saturation S and the brightness V(S) of plural pixels based on input signal values of sub-pixels of these pixels, and calculates the extension coefficient $\alpha_1$ such that the proportion of pixels, in which the value of the extended brightness obtained from the product of the brightness V(S) and the extension coefficient $\alpha_1$ exceeds the maximum value Vmax(S), relative to all the pixels, is equal to or lower than a limit proportion value $\beta$. That is, the signal processing circuit 21 calculates the extension coefficient $\alpha_1$ within a range where a value exceeding the maximum value of brightness, of the values of the extended brightness, does not exceed a value obtained by multiplying the maximum value Vmax(S) by the limit proportion value $\beta$. The limit proportion value $\beta$ is an upper limit value (a proportion) of a proportion of a range exceeding a maximum value of brightness in the extended HSV color space in a combination of hue and saturation values, to the maximum value.

Similarly, the signal processing circuit 22 obtains the maximum value Vmax(S) of brightness, where the saturation S in the HSV color space enlarged by adding the fourth color is a variable, obtains the saturation S and the brightness V(S) of plural pixels based on input signal values of sub-pixels of these pixels, and calculates the extension coefficient $\alpha_2$ such that the proportion of pixels, in which the value of the extended brightness obtained from the product of the brightness V(S) and the extension coefficient $\alpha_2$ exceeds the maximum value Vmax(S), relative to all the pixels, is equal to or lower than the limit proportion value $\beta$. That is, the signal processing circuit 22 calculates the extension coefficient $\alpha_2$ within a range where a value exceeding the maximum value of brightness, of the values of the extended brightness, does not exceed a value obtained by multiplying the maximum value Vmax(S) by the limit proportion value $\beta$. The limit proportion value $\beta$ is an upper limit value (a proportion) of a proportion of a range exceeding a maximum value of brightness in the extended HSV color space in a combination of hue and saturation values, to the maximum value.

The signal processing circuit 21 then decides the extension coefficient $\alpha_A$ based on the extension coefficient $\alpha_1$ and the extension coefficient $\alpha_2$. The signal processing circuit 21 can decide a smaller one of the extension coefficient $\alpha_1$ and the extension coefficient $\alpha_2$ as the extension coefficient $\alpha_A$, for example. Therefore, the display device 10 can suppress reduction in display quality.

The signal processing circuit 21 can decide a larger one of the extension coefficient $\alpha_1$ and the extension coefficient $\alpha_2$ as the extension coefficient $\alpha_A$, for example. Therefore, the display device 10 can further decrease the luminance of the planar light-source device 50, and accordingly reduce power consumption.

The signal processing circuit 21 can decide a value between the extension coefficient $\alpha_1$ and the extension coefficient $\alpha_2$, that is, for example, an average value of the extension coefficient $\alpha_1$ and the extension coefficient $\alpha_2$, as the extension coefficient $\alpha_A$. Therefore, the display device 10 can balance reduction in power consumption with suppressing reduction in display quality.

The saturation S is expressed as S=(Max−Min)/Max, and the brightness V(S) is expressed as V(S)=Max. The value of the saturation S can be from 0 to 1, and the value of the brightness V(S) can be from 0 to $(2^n-1)$, where n is the number of display gradation bits. Max is a maximum value of three sub-pixel input signal values that are a first sub-pixel input signal value, a second sub-pixel input signal value, and a third sub-pixel input signal value for a pixel. Min is a minimum value of three sub-pixel input signal values that are the first sub-pixel input signal value, the second sub-pixel input signal value, and the third sub-pixel input signal value for a pixel. Hue H is expressed by an angle from 0° to 360° as illustrated in FIG. 6. As the angle changes from 0° to 360°, the hue H becomes red, yellow, green, cyan, blue, magenta, and red. In the embodiment, the region including the angle 0° is red, the region including the angle 120° is green, and the region including the angle 240° is blue.

The signal processing circuits 21 and 22 divide the HSV color space (the extended HSV color space) illustrated in FIG. 5 into plural spaces (color spaces) based on at least one of the saturation S, the hue H, and the brightness V, and sets the limit proportion value β for each of divided spaces.

For example, as illustrated in FIGS. 6 and 7, the signal processing circuits 21 and 22 set a limit proportion value β1 for a space, where the hue H is included within 0≤h<360, the saturation S is included within 0.8≤S, and the brightness V is included within 0≤V≤Max, to 0.01 (1%). Also, the signal processing circuits 21 and 22 set a limit proportion value β2 for a space, where the hue H is included within 0≤H<360, the saturation S is included within S≤0.5, and the brightness V is included within 0≤V≤Max, to 0.01 (1%). Also, the signal processing circuits 21 and 22 set a limit proportion value β3 for a space, where the hue H is included within 0≤H<90, the saturation S is included within 0.5<S<0.8, and the brightness V is included within 0≤V≤Max, to 0.025 (2.5%). Also, the signal processing circuits 21 and 22 set a limit proportion value β4 for a space, where the hue H is included within 90≤H<180, the saturation S is included within 0.5<S<0.8, and the brightness V is included within 0≤V≤Max, to 0.025 (2.5%). Also, the signal processing circuits 21 and 22 set a limit proportion value β5 for a space, where the hue H is included within 180≤H<270, the saturation S is included within 0.5<S<0.8, and the brightness V is included within 0≤V≤Max, to 0.025 (2.5%). Also, the signal processing circuits 21 and 22 set a limit proportion value β6 for a space, where the hue H is included within 270≤H<360, the saturation S is included within 0.5<S<0.8, and the brightness V is included within 0≤V≤Max, to 0.025 (2.5%).

That is, in the embodiment, the limit proportion value β when the saturation S is included within 0.5<S<0.8 is different from the limit proportion value β when the saturation S is not included within 0.5<S<0.8 (that is, S≤0.5 or 0.8≤S). Therefore, as illustrated in FIG. 7, a space 61 where S≤0.5, a space 62 where 0.5<S<0.8, and a space 64 where 0.8≤S have different relationships with a limit value line 68 that shows a limit value relative to a maximum value line 66 that shows a maximum value of the brightness V. Accordingly, the signal processing circuits 21 and 22 can make the limit value line 68 different from a limit value line 69 when the limit proportion value β in the HSV color space is a constant as illustrated in FIG. 8.

In FIGS. 7 and 8, a circle represents an input signal value, and a star represents the input signal value that has been extended. In an example illustrated in FIG. 7, an extension coefficient α', by which brightness V(S1') with a saturation value of S1' becomes Vmax (S1') that is a value tangent to the limit value line 68, is defined as the extension coefficients $\alpha_1$ and $\alpha_2$ of a corresponding image. In an example in FIG. 8, an extension coefficient α, by which brightness V(S1) with a saturation value of S1 becomes Vmax (S1) that is a value tangent to the limit value line 69, is defined as the extension coefficients $\alpha_1$ and $\alpha_2$ of the corresponding image.

The signal processing circuits 21 and 22 set the limit proportion value β to different values according to the spaces, and therefore can extend a signal more appropriately. For example, a limit proportion value for a space that exerts a large influence on the display quality is made small, and a limit proportion value for a space that exerts a small influence on the display quality is made large, and therefore an extension coefficient can be increased while maintaining the display quality. For example, as described in the embodiment, a limit proportion value for a space where S is close to 1 (0.8≤S in the embodiment) is smaller than a limit proportion value for a space where S is relatively lower (S<0.8), and accordingly it is possible that while the display quality is maintained in a high-saturation region where a color change is noticeable for human eyes, a high extension coefficient is set in other regions. A limit proportion value for a space where S is close to 0 (S≤0.5 in the present embodiment) is smaller than a limit proportion value for a space where S is relatively higher (0.5<S), and accordingly it is possible that while the display quality is maintained in a non-saturation region where a gradation change is noticeable for human eyes, a high extension coefficient is set in other regions.

Next, in the embodiment, the output signal value $X_{4-(p,q)}$ can be obtained based on the product of a $\mathrm{Min}_{(p,q)}$ and the extension coefficient $\alpha_A$. Specifically, the output signal value $X_{4-(p,q)}$ can be obtained based on the following equation (11).

$$X_{4-(p,q)}=\mathrm{Min}_{(p,q)}\cdot\alpha_A/\chi \tag{11}$$

In the equation (11), the product of the $\mathrm{Min}_{(p,q)}$ and the extension coefficient $\alpha_A$ is divided by χ. However, the present disclosure is not limited thereto. The extension coefficient $\alpha_A$ is decided for each image display frame.

These points are explained below.

Generally, in the (p,q)th pixel, saturation $S_{(p,q)}$ and brightness $V(S)_{(p,q)}$ in a cylindrical HSV color space can be obtained from the following equations based on the first sub-pixel input signal (the signal value $x_{1-(p,q)}$), the second sub-pixel input signal (the signal value $x_{2-(p,q)}$), and the third sub-pixel input signal (the signal value $x_{3-(p,q)}$.

$$S_{(p,q)}=(\mathrm{Max}_{(p,q)}-\mathrm{Min}_{(p,q)})/\mathrm{Max}_{(p,q)} \tag{12-1}$$

$$V(S)_{(p,q)}=\mathrm{Max}_{(p,q)} \tag{12-2}$$

The $\mathrm{Max}_{(p,q)}$ is a maximum value of the three sub-pixel input signal values ($x_{1-(p,q)}$, $x_{2-(p,q)}$ and $x_{3-(p,q)}$). The $\mathrm{Min}_{(p,q)}$ is a minimum value of the three sub-pixel input signal values ($x_{1-(p,q)}$, $x_{2-(p,q)}$, and $x_{3-(p,q)}$). In the embodiment, n=8. That is, the number of display gradation bits is 8 (256 gradations from the display gradation values ranging from 0 to 255).

No color filter is arranged in the fourth sub-pixel 49W that displays a white color. It is assumed that the luminance of a combination of the first sub-pixel 49R, the second sub-pixel 49G, and the third sub-pixel 49B that constitute a pixel or a pixel group, when a signal with a value corresponding to a maximum signal value of a first sub-pixel output signal is input to the first sub-pixel 49R, when a signal with a value corresponding to a maximum signal value of a second sub-pixel output signal is input to the second sub-pixel 49G, and when a signal with a value corresponding to a maximum signal value of a third sub-pixel output signal is input to the third sub-pixel 49B, is represented as $BN_{1-3}$. It is also assumed that the luminance of the fourth sub-pixel 49W, when a signal with a value corresponding to a maximum signal value of a fourth sub-pixel output signal is input to the fourth sub-pixel 49W that constitutes a pixel or a pixel group, is represented as $BN_4$. That is, a white color with the maximum luminance is displayed by the combination of the first sub-pixel 49R, the second sub-pixel 49G, and the third sub-pixel 49B, and the luminance of the white color is represented as $BN_{1-3}$. Accordingly, when $\chi$ is a constant dependent on a display device, the constant $\chi$ is expressed as $\chi=BN_4/BN_{1-3}$.

Specifically, the luminance $BN_4$ when an input signal with the display gradation value 255 is assumed to be input to the fourth sub-pixel 49W is, for example, one and a half times as high as the luminance $BN_{1-3}$ of the white color when input signals with the following display gradation values, $x_{1-(p,q)}=255$, $x_{2-(p,q)}=255$, and $x_{3-(p,q)}=255$ are input to the combination of the first sub-pixel 49R, the second sub-pixel 49G, and the third sub-pixel 49B, respectively. That is, in the embodiment, $\chi=1.5$.

Meanwhile, when the signal value $X_{4-(p,q)}$ is given by the equation (11) described above, Vmax(S) can be expressed by the following equation.

In a case where $S \le S_0$:

$$V\max(S)=(\chi+1)\cdot(2^n-1) \tag{13-1}$$

In a case where $S_0<S\le 1$:

$$V\max(S)=(2^n-1)\cdot(1/S) \tag{13-2}$$

where $S_0=1/(\chi+1)$.

The maximum value Vmax(S) of brightness, where the saturation S in the HSV color space enlarged by adding the fourth color is a variable, is obtained in the manner as described above, and is stored in the signal processing circuits 21 and 22 as a kind of look-up table, or is obtained by the signal processing circuits 21 and 22 as needed.

Next, the method of obtaining the output signal values of the (p,q)th pixel, $X_{1-(p,q)}$, $X_{2-(p,q)}$, $X_{3-(p,q)}$, and $X_{4-(p,q)}$ (extension processing), will be explained below. The following processing is performed so as to maintain the proportion of the luminance of the first primary color displayed by (the first sub-pixel 49R+the fourth sub-pixel 49W), the luminance of the second primary color displayed by (the second sub-pixel 49G+the fourth sub-pixel 49W), and the luminance of the third primary color displayed by (the third sub-pixel 49B+the fourth sub-pixel 49W). Moreover, the processing is performed so as to hold (to maintain) the color tone. Further, the processing is performed so as to hold (to maintain) the gradation-luminance characteristics (gamma characteristics, $\gamma$ characteristics).

In a case where input signal values of any of pixels or of pixel groups are all "0" (or are all small), it suffices that the extension coefficients $\alpha_1$ and $\alpha_2$ are obtained without including such a pixel or such a pixel group.

[Step-100A]

First, based on input signal values of sub-pixels in plural pixels, the $\alpha$-calculation unit 211*a* in the signal processing circuit 21 obtains the saturation S and the brightness V(S) of these pixels. Specifically, $S_{(p,q)}$ and $V(S)_{(p,q)}$ are obtained from the equations (12-1) and (12-2), respectively, based on the first sub-pixel input signal value $x_{1-(p,q)}$, the second sub-pixel input signal value $x_{2-(p,q)}$, and the third sub-pixel input signal value $x_{3-(p,q)}$ to the (p,q)th pixel (where and $1\le p\le I$ and $1\le q\le Q_0$). This processing is performed on all the pixels.

[Step-100B]

Similarly, based on input signal values of sub-pixels in plural pixels, the $\alpha$-calculation unit 221*a* in the signal processing circuit 22 obtains the saturation S and the brightness V(S) of these pixels. Specifically, and $V(S)_{(p,q)}$ are obtained from the equations (12-1) and (12-2), respectively, based on the first sub-pixel input signal value the $x_{1-(p,q)}$, second sub-pixel input signal value $x_{2-(p,q)}$, and the third sub-pixel input signal value $x_{3-(p,q)}$ to the (p,q)th pixel (where $I<p\le P_0$ and $1\le q\le Q_0$). This processing is performed on all the pixels.

[Step-110A]

Next, the $\alpha$-calculation unit 211*a* in the signal processing circuit 21 obtains an extension coefficient $\alpha_1(S)$ based on the Vmax(S)/V(S) obtained for plural pixels.

$$\alpha_1(S)=V\max(S)/V(S) \tag{14-1}$$

Values of the extension coefficients $\alpha_1(S)$ obtained for plural pixels (the number of the pixels is $I\times Q_0$ (where $1\le I<P_0$) in the embodiment) are sorted in ascending order. Among the values of the extension coefficients $\alpha_1(S)$, where the number of these values is $I\times Q_0$, a value of an extension coefficient $\alpha_1(S)$ which corresponds to the $\beta\times I\times Q_0$-th smallest extension coefficient $\alpha_1(S)$ from a minimum value of the sorted extension coefficients $\alpha_1(S)$ is defined as the extension coefficient $\alpha_1$. In this manner, the extension coefficient $\alpha_1$ can be decided such that the proportion of pixels, in which the value of the extended brightness, obtained from the product of the brightness V(S) and the extension coefficient $\alpha_1$, exceeds the maximum value Vmax(S), relative to all the pixels, is equal to or lower than a predetermined value ($\beta$).

In the embodiment, the limit proportion value $\beta$ is preferably equal to or larger than 0 and equal to or smaller than 0.2 (equal to or larger than 0% and equal to or smaller than 20%), more preferably equal to or larger than 0.0001 and equal to or smaller than 0.20 (equal to or larger than 0.01% and equal to or smaller than 20%), and even more preferably equal to or larger than 0.003 and equal to or smaller than 0.05 (equal to or larger than 0.3% and equal to or smaller than 5%), for example. This $\beta$ value is decided through performing various kinds of tests.

When the minimum value of Vmax(S)/V(S) is used as the extension coefficient $\alpha_1$, an output signal value relative to an input signal value does not exceed $(2^8-1)$. However, when the extension coefficient $\alpha_1$ is not the minimum value of Vmax(S)/V(S), but is decided in the manner as described above, the brightness for a pixel, in which the extension coefficient $\alpha_1(S)$ is smaller than the extension coefficient $\alpha_1$, is multiplied by the extension coefficient $\alpha_1$, and the value of the extended brightness exceeds the maximum value Vmax(S). As a result, so-called "gradation loss" occurs. However, the $\beta$ value is, for example, between 0.003 and 0.05 as described above, and therefore the occurrence of a phenomenon in which gradation loss is noticeable and an image looks unnatural is able to be prevented. On the other hand, when the β value exceeded 0.05, an unnatural image with noticeable gradation loss is confirmed in some cases. When an output signal value exceeds $(2^n-1)$ that is a limit value through the extension processing, it suffices that the output signal value is set to $(2^n-1)$ that is the limit value.

Normally, values of the extension coefficient $\alpha_1(S)$ exceed 1.0, and often gather near 1.0. Therefore, when the minimum value of Vmax(S)/V(S) is used as the extension coefficient $\alpha_1$, the output signal value is extended to a small degree, and it is often difficult to achieve low power consumption in a display device. Accordingly, the β value is set equal to or larger than 0 and equal to or smaller than 0.2, for example, and consequently the value of the extension coefficient $\alpha_1$ in at least a part of a space can be made large. It suffices that the luminance of the planar light-source device 50 is multiplied by a factor of $(1/\alpha_1)$ as described later, and thus it is possible to achieve low power consumption in a display device.

[Step-110B]

Similarly, the α-calculation unit 221*a* in the signal processing circuit 22 obtains an extension coefficient $\alpha_2(S)$ based on the Vmax(S)/V(S) obtained for plural pixels.

$$\alpha_2(S)=V\max(S)/V(S) \tag{14-2}$$

Values of the extension coefficients $\alpha_2(S)$ obtained for plural pixels (the number of the pixels is $(P_0-I)\times Q_0$ (where $1\leq I<P_0$) in the embodiment) are sorted in ascending order. Among the values of the extension coefficients $\alpha_2(S)$, where the number of these values is $(P_0-I)\times Q_0$, value of an extension coefficient $\alpha_2(S)$ which corresponds to the $\beta\times(P_0-I)\times Q_0$-th smallest extension coefficient $\alpha_2(S)$ from a minimum value of the sorted extension coefficients $\alpha_2(S)$ is defined as the extension coefficient $\alpha_2$. In this manner, the extension coefficient $\alpha_2$ can be decided such that the proportion of pixels, in which the value of the extended brightness, obtained from the product of the brightness V(S) and the extension coefficient $\alpha_2$, exceeds the maximum value Vmax(S), relative to all the pixels, is equal to or lower than a predetermined value (β).

In the embodiment, the limit proportion value β is preferably equal to or larger than 0 and equal to or smaller than 0.2 (equal to or larger than 0% and equal to or smaller than 20%), more preferably equal to or larger than 0.0001 and equal to or smaller than 0.20 (equal to or larger than 0.01% and equal to or smaller than 20%), and even more preferably equal to or larger than 0.003 and equal to or smaller than 0.05 (equal to or larger than 0.3% and equal to or smaller than 5%), for example. This β value is decided through performing various kinds of tests.

When the minimum value of Vmax(S)/V(S) is used as the extension coefficient $\alpha_2$, an output signal value relative to an input signal value does not exceed $(2^8-1)$. However, when the extension coefficient $\alpha_2$ is not the minimum value of Vmax(S)/V(S), but is decided in the manner as described above, the brightness for a pixel, in which the extension coefficient $\alpha_2(S)$ is smaller than the extension coefficient $\alpha_2$, is multiplied by the extension coefficient $\alpha_2$, and the value of the extended brightness exceeds the maximum value Vmax(S). As a result, so-called "gradation loss" occurs. However, the β value is, for example, between 0.003 and 0.05 as described above, and therefore the occurrence of a phenomenon in which gradation loss is noticeable and an image looks unnatural is able to be prevented. On the other hand, when the β value exceeded 0.05, an unnatural image with noticeable gradation loss is confirmed in some cases. When an output signal value exceeds $(2^n-1)$ that is a limit value through the extension processing, it suffices that the output signal value is set to $(2^n-1)$ that is the limit value.

Normally, values of the extension coefficient $\alpha_2(S)$ exceed 1, and often gather near 1.0. Therefore, when the minimum value of Vmax(S)/V(S) is used as the extension coefficient $\alpha_2$, the output signal value is extended to a small degree, and it is often difficult to achieve low power consumption in a display device. Accordingly, the β value is set equal to or larger than 0 and equal to or smaller than 0.2, for example, and consequently the value of the extension coefficient $\alpha_2$ in at least a part of a space can be made large. It suffices that the luminance of the planar light-source device 50 is multiplied by a factor of $(1/\alpha_2)$ as described later, and thus it is possible to achieve low power consumption in a display device.

The α-transmission/reception unit 222 in the signal processing circuit 22 transmits the extension coefficient $\alpha_2$ calculated in the manner as described above to the α-transmission/reception unit 212 in the signal processing circuit 21.

[Step-115]

Next, the α-aggregation unit 213 in the signal processing circuit 21 aggregates the extension coefficient $\alpha_1$ calculated by the α-calculation unit 211*a*, and the extension coefficient $\alpha_2$ received by the α-transmission/reception unit 212 to decide an extension coefficient $\alpha_A$ of the image display panel 30 in its entirety. That is, the α-aggregation unit 213 decides the extension coefficient $\alpha_A$ based on the extension coefficient $\alpha_1$ and the extension coefficient $\alpha_2$.

Specifically, the α-aggregation unit 213 can decide a smaller one of the extension coefficient $\alpha_1$ and the extension coefficient $\alpha_2$ as the extension coefficient $\alpha_A$, for example. Therefore, the display device 10 can suppress reduction in display quality.

The α-aggregation unit 213 can decide a larger one of the extension coefficient $\alpha_1$ and the extension coefficient $\alpha_2$ as the extension coefficient $\alpha_A$, for example. Therefore, the display device 10 can further decrease the luminance of the planar light-source device 50, and accordingly reduce power consumption.

The α-aggregation unit 213 can decide a value between the extension coefficient $\alpha_1$ and the extension coefficient $\alpha_2$, that is, for example, an average value of the extension coefficient $\alpha_1$ and the extension coefficient $\alpha_2$, as the extension coefficient $\alpha_A$. Therefore, the display device 10 can balance reduction in power consumption with suppressing reduction in display quality.

[Step-120A]

Next, the extension processing unit 211*b* in the signal processing circuit 21 obtains the signal value $X_{4-(p,q)}$ of the (p,q)th pixel (where and $1\leq p\leq I$ and $1\leq q\leq Q_0$) based on at least the signal value $x_{1-(p,q)}$, the signal value $x_{2-(p,q)}$ and the signal value $x_{3-(p,q)}$. Specifically, in the embodiment, the signal value $X_{4-(p,q)}$ is decided based on the $\mathrm{Min}_{(p,q)}$, the extension coefficient $\alpha_A$, and the constant χ. More specifically, in the embodiment, the signal value $X_{4-(p,q)}$ is obtained based on the following equation (11) as described above.

$$X_{4-(p,q)}=\mathrm{Min}_{(p,q)}\cdot\alpha_A/\chi \tag{11}$$

$X_{4-(p,q)}$ is obtained for all pixels, where the number of the pixels is $I\times Q_0$.

[Step-120B]

Similarly, the extension processing unit 221*b* in the signal processing circuit 22 obtains the signal value $X_{4-(p,q)}$ of the (p,q)th pixel (where $I<p\leq P_0$ and $1\leq q\leq Q_0$)) based on at least the signal value $x_{1-(p,q)}$, the signal value $x_{2-(p,q)}$, and the signal value $x_{3-(p,q)}$. Specifically, in the embodiment, the signal value $X_{4-(p,q)}$ is decided based on the $Min_{(p,q)}$, the extension coefficient $\alpha_A$, and the constant $\chi$. More specifically, in the embodiment, the signal value $X_{4-(p,q)}$ is obtained based on the equation (11) as described above. $X_{4-(p,q)}$ is obtained for all pixels, where the number of the pixels is $(P_0-I)\times Q_0$.

[Step-130A]

Thereafter, the extension processing unit 211*b* in the signal processing circuit 21 obtains the signal value $X_{1-(p/q)}$ of the (p,q)th pixel (where and $1\leq p\leq I$ and $1\leq q\leq Q_0$) based on the signal value $x_{1-(p,q)}$, the extension coefficient $\alpha_A$, and the signal value $X_{4-(p,q)}$, also obtains the signal value $X_{2-(p,q)}$ of the (p,q)th pixel based on the signal value $x_{2-(p,q)}$, the extension coefficient $\alpha_A$, and the signal value $X_{4-(p,q)}$, and also obtains the signal value $X_{3-(p,q)}$ of the (p,q)th pixel based on the signal value $x_{3-(p,q)}$, the extension coefficient $\alpha_A$, and the signal value $X_{4-(p,q)}$. Specifically, the signal value $X_{1-(p,q)}$, the signal value $X_{2-(p,q)}$, and the signal value $X_{3-(p,q)}$ of the (p,q)th pixel are obtained based on the following equations as described above.

$$X_{1-(p,q)}=\alpha_A x_{1-(p,q)}-\chi X_{4-(p,q)}$$

$$X_{2-(p,q)}=\alpha_A x_{2-(p,q)}-\chi X_{4-(p,q)}$$

$$X_{3-(p,q)}=\alpha_A x_{3-(p,q)}-\chi X_{4-(p,q)}$$

As expressed by the equation (11), the extension processing unit 211*b* in the signal processing circuit 21 extends the value of $Min_{(p,q)}$ by $\alpha_A$. As described above, the value of $Min_{(p,q)}$ is extended by the extension coefficient $\alpha_A$, and therefore not only the luminance of a white display sub-pixel (the fourth sub-pixel 49W) increases, but also the luminance of a red display sub-pixel, a green display sub-pixel, and a blue display sub-pixel (the first sub-pixel 49R, the second sub-pixel 49G, and the third sub-pixel 49B) increases, as expressed by the above equations. Accordingly, the occurrence of problems such as causing dullness of colors can be reliably avoided. That is, because the value of $Min_{(p,q)}$ is extended by $\alpha_A$, the luminance of the entire image is $\alpha_A$ times as high as that in the case where the value of $Min_{(p,q)}$ is not extended. Therefore, an image such as a still image can be displayed with high luminance, which is preferable.

[Step-130B]

Similarly, the extension processing unit 221*b* in the signal processing circuit 22 obtains the signal value $X_{1-(p,q)}$ of the (p,q)th pixel (where $I<p\leq P_0$ and $1\leq q\leq Q_0$) based on the signal value the extension coefficient $\alpha_A$, and the signal value $X_{4-(p,q)}$, also obtains the signal value $X_{2-(p,q)}$ of the (p,q)th pixel based on the signal value $x_{2-(p,q)}$, the extension coefficient $\alpha_A$, and the signal value $X_{4-(p,q)}$, and also obtains the signal value $X_{3-(p,q)}$ of the (p,q)th pixel based on the signal value $x_{3-(p,q)}$, the extension coefficient $\alpha_A$, and the signal value $X_{4-(p,q)}$. Specifically, the signal value $X_{1-(p,q)}$, the signal value $X_{2-(p,q)}$, and the signal value $X_{3-(p,q)}$ of the (p,q)th pixel are obtained based on the following equations as described above.

$$X_{1-(p,q)}=\alpha_A x_{1-(p,q)}-\chi X_{4-(p,q)}$$

$$X_{2-(p,q)}=\alpha_A x_{2-(p,q)}-\chi X_{4-(p,q)}$$

$$X_{3-(p,q)}=\alpha_A x_{3-(p,q)}-\chi X_{4-(p,q)}$$

As expressed by the equation (11), the extension processing unit 221*b* in the signal processing circuit 22 extends the value of $Min_{(p,q)}$ by $\alpha_A$. As described above, the value of $Min_{(p,q)}$ is extended by $\alpha_A$, and therefore not only the luminance of a white display sub-pixel (the fourth sub-pixel 49W) increases, but also the luminance of a red display sub-pixel, a green display sub-pixel, and a blue display sub-pixel (the first sub-pixel 49R, the second sub-pixel 49G, and the third sub-pixel 49B) increases, as expressed by the above equations. Accordingly, the occurrence of problems such as causing dullness of colors can be reliably avoided. That is, because the value of $Min_{(p,q)}$ is extended by $\alpha_A$, the luminance of the entire image is $\alpha_A$ times as high as that in the case where the value of $Min_{(p,q)}$ is not extended. Therefore, an image such as a still image can be displayed with high luminance, which is preferable.

In the display device according to the embodiment, the signal value $X_{1-(p,q)}$, the signal value $X_{2-(p,q)}$, the signal value $X_{3-(p,q)}$, and the signal value $X_{4-(p,q)}$ of the (p,q)th pixel are extended by a factor of $\alpha_A$. Therefore, it suffices that the luminance of the planar light-source device 50 is decreased based on the extension coefficient $\alpha_A$ in order to have the same image luminance as the luminance of an unextended image. Specifically, it suffices that the luminance of the planar light-source device 50 is multiplied by a factor of $(1/\alpha_A)$. Accordingly, reduction in power consumption in the planar light-source device 50 can be achieved. The signal processing circuit 21 outputs this $(1/\alpha_A)$ to the planar light-source device control circuit 60 (see FIG. 1) as a planar light-source device control signal.

As described above, by dividing an HSV color space into plural spaces, and setting the limit proportion value $\beta$ for each of the divided spaces, the display device according to the embodiment can set an extension coefficient to a value at which power consumption can be reduced while maintaining the display quality.

In the above embodiment, the HSV color space is divided based on hue and saturation as references, that is, respective threshold values of hue and saturation are set to divide the HSV color space into spaces using the threshold values as boundaries. However, the present disclosure is not limited thereto. It suffices that the signal processing circuits 21 and 22 divide the HSV color space based on at least one of hue, saturation, and brightness as a reference, as described above. Therefore, the HSV color space can also be divided based on one of three parameters that are hue, saturation, and brightness as a reference, or the HSV color space can also be divided based on two of the three parameters as references, or the HSV color space can also be divided based on all the three parameters as references.

Figure 9:
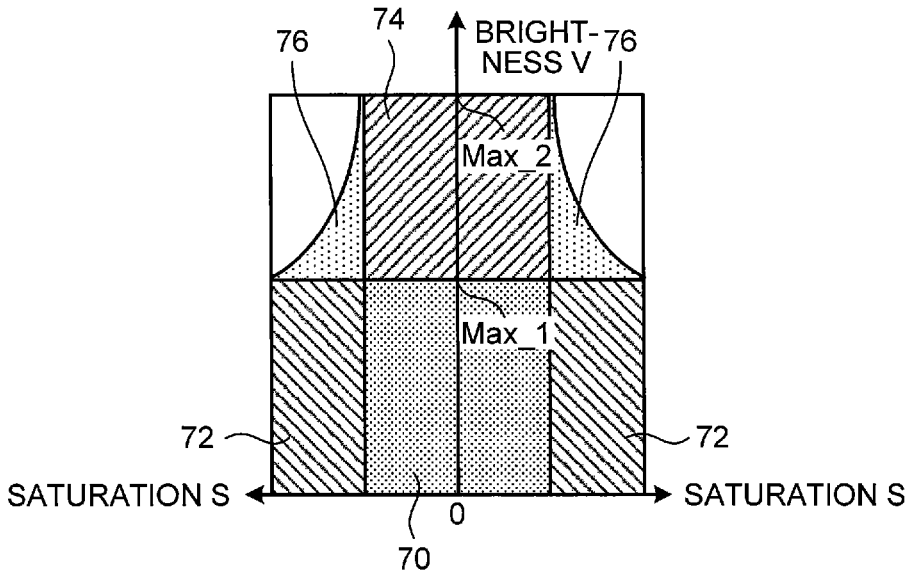
FIG. 9 is a conceptual diagram illustrating a relationship between saturation and brightness in an extended HSV color space.
Figure 10:
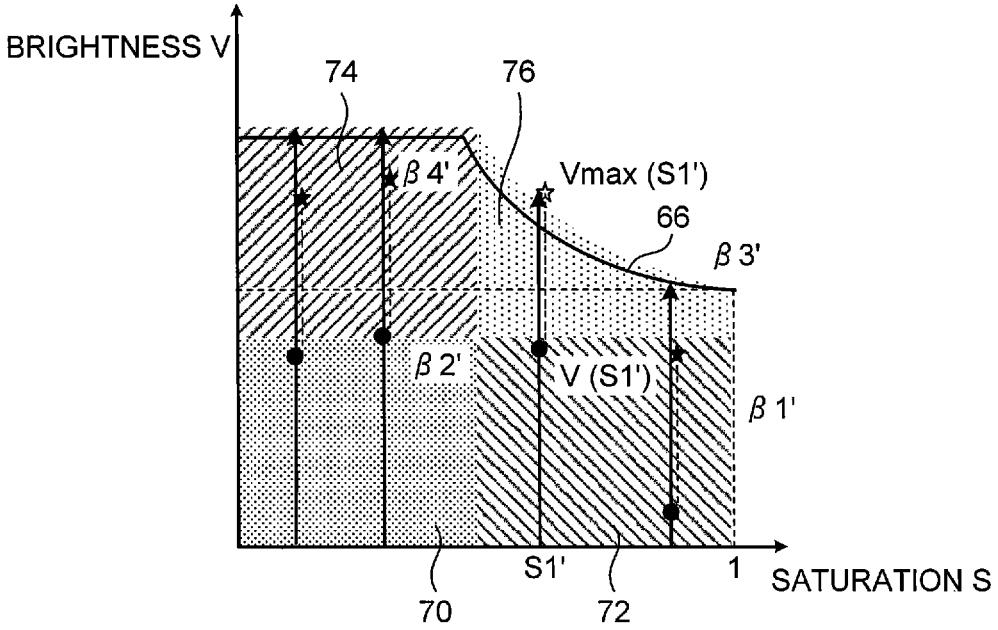
FIG. 10 is a conceptual diagram illustrating relationship between saturation and brightness in an extended HSV color space.

An example in which an HSV color space (an extended HSV color space) is divided is explained below with reference to FIGS. 9 and 10. FIG. 9 is a conceptual diagram illustrating a relationship between saturation and brightness in the extended HSV color space. FIG. 10 is a conceptual diagram illustrating a relationship between saturation and brightness in the extended HSV color space. In an example illustrated in FIGS. 9 and 10, a limit proportion value $\beta 1'$ in a space 72, where the hue H is included within $0\leq H<360$, the saturation S is included within $0.5\leq S$, and the brightness V is included within $0\leq V\leq Max_1$, is set to 0.01 (1%). Also, a limit proportion value $\beta 2'$ in a space 70, where the hue H is included within $0\leq H<360$, the saturation S is included within $S<0.5$, and the brightness V is included within $0\leq V\leq Max_1$, is set to 0.01 (1%). Also, a limit proportion value $\beta 3'$ in a space 76, where the hue H is included within $0\leq H<360$, the saturation S is included within $0.5\leq S$, and the brightness V is included within $Max_1<V\leq Max_2$, is set to 0.03 (3%). Also, a limit proportion value $\beta 4'$ in a space 74, where the hue H is included within $0\leq H<360$, the saturation S is included within $S<0.5$, and the brightness V is included within $Max_1<V\leq Max_2$, is set to 0.03 (3%).

That is, in the example illustrated in FIGS. 9 and 10, the limit proportion value β in a case where the brightness V is included within 0≤V≤Max_1 is different from the limit proportion value β in a case where the brightness V is not included within 0≤V≤Max_1 (that is, Max_1<V≤Max_2). Therefore, as illustrated in FIGS. 9 and 10, the space 70 where S≤0.5 and 0≤V≤Max_1 and the space 72 where 0.5<S and 0≤v≤Max_1 have a relationship with a limit value line that shows a limit value relative to the maximum value line 66 that shows a maximum value of the brightness V, different from the space 74 where S≤0.5 and Max_1<V≤Max_2 and the space 76 where 0.5<S and Max_1<V≤Max_2.

It suffices that the display device 10 divides the extended HSV color space into plural spaces, and sets different limit proportion values for each of at least two spaces of the divided spaces. In a part of the extended HSV color space, a space where a limit proportion value is not set, that is, a space that is not an analysis target at the time of calculating an extension coefficient, can also be provided. The display device 10 can set a limit proportion value appropriate to each of restriction-target spaces, and therefore can obtain the advantages described above, although a limit proportion value is not set for a part of the space.

The display device 10 can also include plural pieces of data that shows a rule for dividing the extended HSV color space into plural spaces and information regarding a limit proportion value set for each of the divided spaces, and change the data that is used. For example, the display device 10 can also change the rule that is used for dividing the extended HSV color space into plural spaces, and change the information regarding the limit proportion value set for each of the divided spaces, depending on whether a displayed image is a moving image or a still image. The display device 10 can also change the data that is used according to the usage environment (indoor or outdoor, and in light or dark).

In the above descriptions, the display device 10 divides the extended HSV color space. However, it suffices that the display device 10 does not divide the extended HSV color space.

Figure 11:
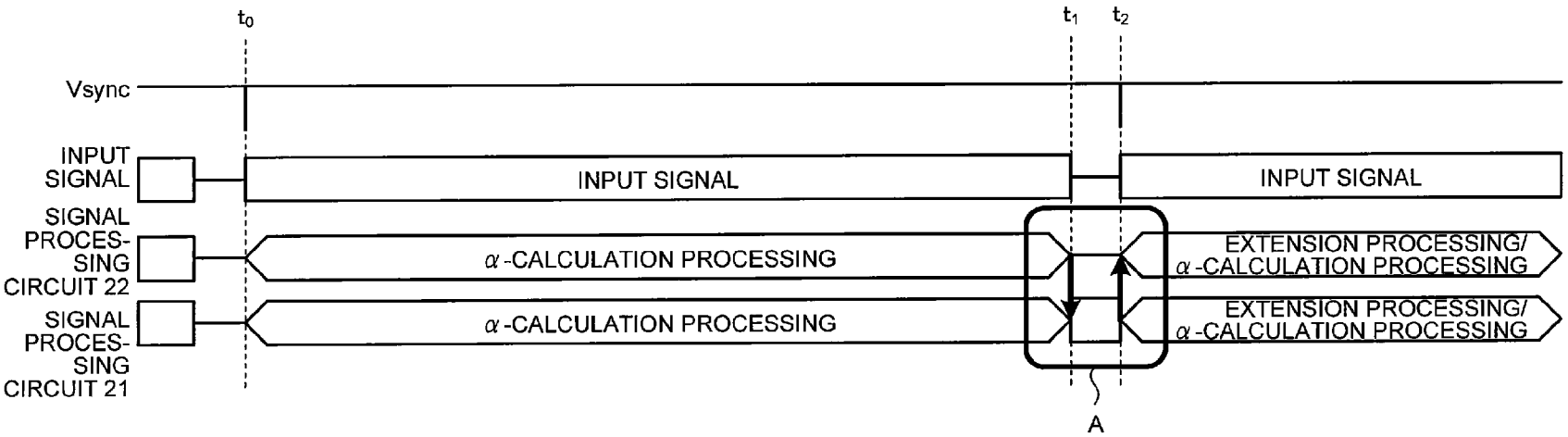
FIG. 11 is a timing diagram illustrating an operation timing of the signal processing circuit.
Figure 12:
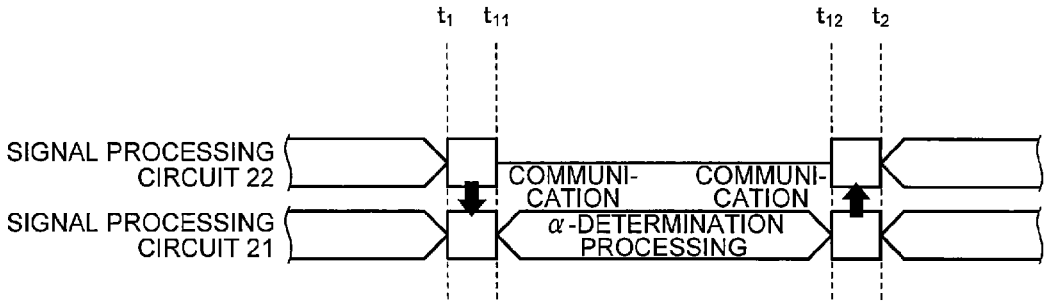
FIG. 12 is a timing diagram illustrating an operation timing of the signal processing circuit.

FIGS. 11 and 12 are timing diagrams illustrating an operation timing of the signal processing circuit. As illustrated in FIG. 11, the signal processing circuits 21 and 22 operate in synchronization with a vertical synchronizing signal Vsync.

Simultaneously with inputting the vertical synchronizing signal Vsync at a time $t_0$, the input signals ($x_{1-(p,q)}$, $x_{2-(p,q)}$, and $x_{3-(p,q)}$) (where 1≤p≤I and 1≤q≤$Q_0$) are input to the signal processing circuit 21, and also the input signals ($x_{1-(p,q)}$, $x_{2-(p,q)}$, and $x_{3-(p,q)}$) (where I≤p≤$P_0$ and 1≤q≤$Q_0$) are input to the signal processing circuit 22 between the time $t_0$ and a time $t_1$.

The α-calculation unit 211*a* in the signal processing circuit 21 calculates the extension coefficient $\alpha_1$ and its inverse $1/\alpha_1$ based on the input signals ($x_{1-(p,q)}$, $x_{2-(p,q)}$, and $x_{3-(p/q)}$) (where 1≤p≤I and 1≤q≤$Q_0$). In parallel with that, the α-calculation unit 221*a* in the signal processing circuit 22 calculates the extension coefficient $\alpha_2$ and its inverse $1/\alpha_2$ based on the input signals ($x_{1-(p,q)}$, $x_{2-(p,q)}$, and $x_{3-(p,q)}$ (where I<p≤$P_0$ and 1≤q≤$Q_0$).

The extension coefficient $\alpha_A$ is then decided between the time $t_1$ and a time $t_2$ at which the next vertical synchronizing signal Vsync is input.

FIG. 12 is an enlarged view of an A-portion between the time $t_1$ and the time $t_2$ in FIG. 11. As illustrated in FIG. 12, the α-transmission/reception unit 222 in the signal processing circuit 22 that operates as a slave transmits the extension coefficient $\alpha_2$ and its inverse $1/\alpha_2$ to the α-transmission/reception unit 212 in the signal processing circuit 21 between the time $t_1$ and a time $t_{11}$. The α-transmission/reception unit 212 outputs the received extension coefficient $\alpha_2$ and its inverse $1/\alpha_2$ to the α-aggregation unit 213.

Assuming that the bit width of the extension coefficient $\alpha_2$ is 10 bits, and the bit width of $1/\alpha_2$ is 10 bits, the data amount to be transmitted from the α-transmission/reception unit 222 in the signal processing circuit 22 to the α-transmission/reception unit 212 in the signal processing circuit 21 is 20 bits, which is very small.

In a case where there are two or more signal processing circuits that operate as a slave, the bus cycle from the time $t_1$ to the time $t_{11}$ is performed by the number of slaves.

The α-aggregation unit 213 in the signal processing circuit 21 decides the extension coefficient $\alpha_A$ based on the extension coefficient $\alpha_1$ calculated by the α-calculation unit 211*a* and based on the extension coefficient $\alpha_2$ received by the α-transmission/reception unit 212 between the time $t_{11}$ and a time $t_{12}$.

The α-aggregation unit 213 can decide a smaller one of the extension coefficient $\alpha_1$ and the extension coefficient $\alpha_2$ as the extension coefficient $\alpha_A$, for example. Therefore, the display device 10 can suppress reduction in display quality.

The α-aggregation unit 213 can decide a larger one of the extension coefficient $\alpha_1$ and the extension coefficient $\alpha_2$ as the extension coefficient $\alpha_A$, for example. Therefore, the display device 10 can further decrease the luminance of the planar light-source device 50, and accordingly reduce power consumption.

The α-aggregation unit 213 can decide a value between the extension coefficient $\alpha_1$ and the extension coefficient $\alpha_2$, that is, for example, an average value of the extension coefficient $\alpha_1$ and the extension coefficient $\alpha_2$, as the extension coefficient $\alpha_A$. Therefore, the display device 10 can balance reduction in power consumption with suppressing reduction in display quality.

The α-transmission/reception unit 212 in the signal processing circuit 21 transmits the extension coefficient $\alpha_A$ and its inverse $1/\alpha_A$ decided by the α-aggregation unit 213 to the α-transmission/reception unit 222 in the signal processing circuit 22 between the time $t_{12}$ and the time $t_2$. The α-transmission/reception unit 222 outputs the received extension coefficient $\alpha_A$ and the received inverse $1/\alpha_A$ to the extension processing unit 221*b*.

Even in a case where there are two or more signal processing circuits that operate as a slave, the bus cycle from the time $t_{12}$ to the time $t_2$ is performed only once.

Assuming that the bit width of the extension coefficient $\alpha_A$ is 10 bits, and the bit width of $1/\alpha_A$ is 10 bits, the data amount to be transmitted from the α-transmission/reception unit 212 in the signal processing circuit 21 to the α-transmission/reception unit 222 in the signal processing circuit 22 is 20 bits, which is very small.

Referring back to FIG. 11, at the time $t_2$ and later, the extension processing unit 211*b* in the signal processing circuit 21 uses the extension coefficient $\alpha_A$ decided between the time $t_1$ and the time $t_2$ to perform the extension processing on the input signals ($x_{1-(p,q)}$, $x_{2-(p,q)}$, and $x_{3-(p,q)}$) (where 1≤p≤I and 1≤q≤$Q_0$) input between the time $t_0$ and the time $t_1$. In parallel with that, the α-calculation unit 211*a* in the signal processing circuit 21 calculates the extension coefficient $\alpha_1$ of the next frame based on the input signals of the next frame ($x_{1-(p,q)}$, $x_{2-(p,q)}$, and $x_{3-(p,q)}$) (where and 1≤p≤I and 1≤q≤$Q_0$) which are input at the time $t_2$ and later.

At the time $t_2$ and later, the extension processing unit 221*b* in the signal processing circuit 22 uses the extension coefficient $\alpha_A$ decided between the time $t_1$ and the time $t_2$ to perform the extension processing on the input signals ($x_{1-(p,q)}$, $x_{2-(p,q)}$, and $x_{3-(p,q)}$) (where $1<p\leq P_0$ and $1\leq q\leq Q_0$) input between the time $t_0$ and the time $t_1$. In parallel with that, the α-calculation unit 221*a* in the signal processing circuit 22 calculates the extension coefficient $\alpha_2$ of the next frame based on the input signals of the next frame ($x_{1-(p,q)}$, $x_{2-(p,q)}$, and $x_{3-(p,q)}$) (where $1<p\leq P_0$ and $1\leq q\leq Q_0$) which are input at the time $t_2$ and later.

Control Operation of Display Device

Figure 13:
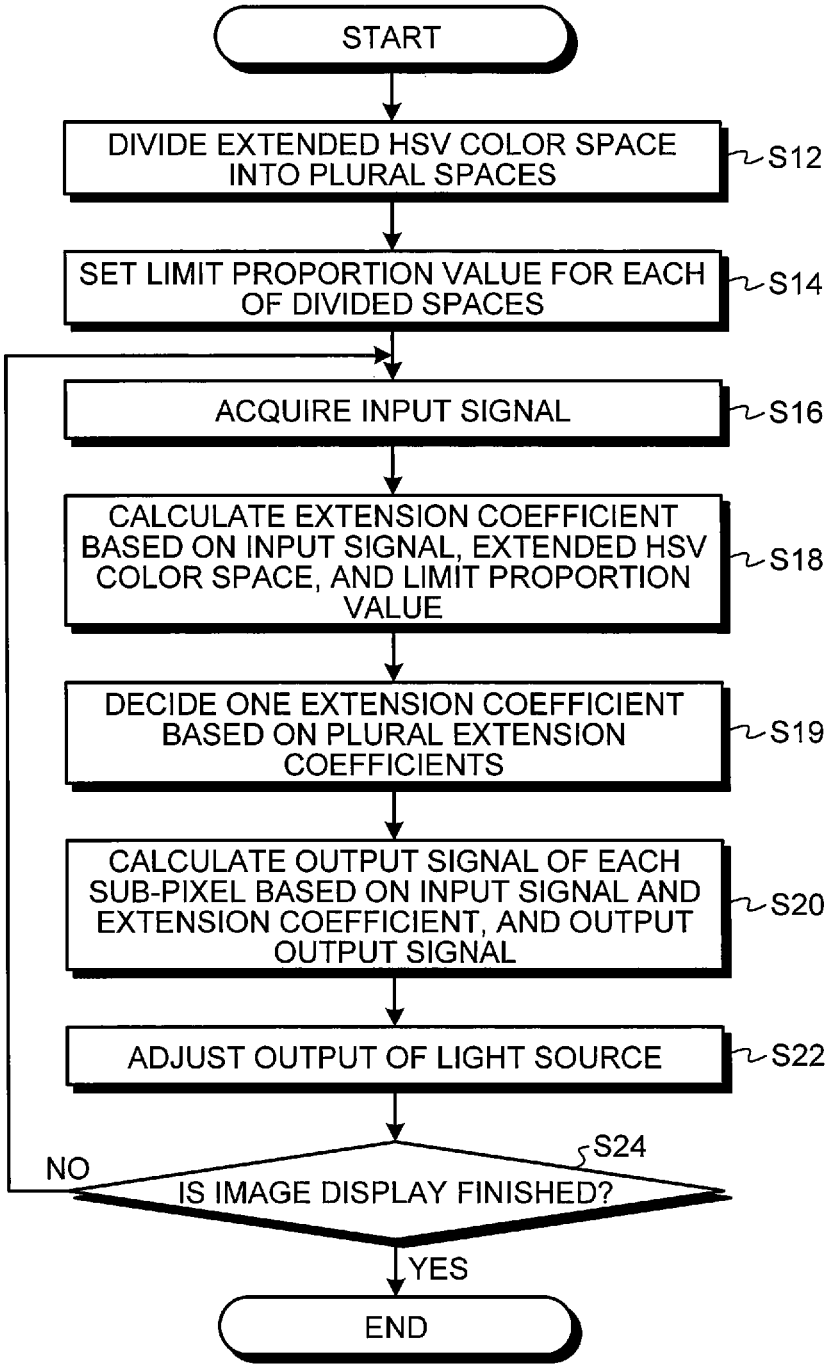
FIG. 13 is a flowchart illustrating an example of a control operation of the display device.

Next, an example of a control operation of a display device is explained below with reference to FIG. 13. FIG. 13 is a flowchart illustrating an example of the control operation of the display device. The display device 10 implements the processing illustrated in FIG. 13 by performing arithmetic processing mainly by the signal processing circuits 21 and 22.

The signal processing circuits 21 and 22 divide an extended HSV color space into plural spaces (Step S12), and set a limit proportion value for each of the divided spaces (Step S14). The signal processing circuits 21 and 22 read stored data to divide the extended HSV color space and to set the limit proportion values.

After setting the limit proportion values, the signal processing circuits 21 and 22 acquire an input signal (Step S16), and calculate the extension coefficients $\alpha_1$ and $\alpha_2$, respectively, based on the acquired input signal, the extended HSV color space (a maximum value of brightness), and the limit proportion value set for a space according to the input signal (Step S18). Specifically, the processing is performed through the above steps to obtain an extension coefficient such that a portion of an extended output signal, which exceeds the extended HSV color space (the maximum value of brightness), with respect to the extended entire output signal, does not exceed the limit proportion value.

Next, the signal processing circuit 22 transmits the extension coefficient $\alpha_2$ to the signal processing circuit 21, and the signal processing circuit 21 decides one extension coefficient $\alpha_A$ based on plural extension coefficients $\alpha_1$ and $\alpha_2$ (Step S19).

The signal processing circuit 21 can decide a smaller one of the extension coefficient $\alpha_1$ and the extension coefficient $\alpha_2$ as the extension coefficient $\alpha_A$, for example. Therefore, the display device 10 can suppress reduction in display quality.

The signal processing circuit 21 can decide a larger one of the extension coefficient $\alpha_1$ and the extension coefficient $\alpha_2$ as the extension coefficient $\alpha_A$, for example. Therefore, the display device 10 can further decrease the luminance of the planar light-source device 50, and accordingly reduce power consumption.

The signal processing circuit 21 can decide a value between the extension coefficient $\alpha_1$ and the extension coefficient $\alpha_2$ that is, for example, an average value of the extension coefficient $\alpha_1$ and the extension coefficient $\alpha_2$, as the extension coefficient $\alpha_A$ Therefore, the display device 10 can balance reduction in power consumption with suppressing reduction in display quality.

Thereafter, the signal processing circuits 21 and 22 calculate an output signal of each sub-pixel based on the input signal and the extension coefficient $\alpha_A$, and output the output signal (Step S20). Further, the signal processing circuit 21 adjusts an output of a light source (Step S22). That is, the signal processing circuits 21 and 22 output the extended output signal to the image-display-panel drive circuit 40. Furthermore, the signal processing circuit 21 outputs a condition ($1/\alpha_A$) of the output of the light source (the planar light-source device 50), calculated according to a result of the extension, to the planar light-source device control circuit 60 as a planar light-source device control signal.

After adjusting the output of the light source, the signal processing circuits 21 and 22 determine whether image display is finished (Step S24). When the signal processing circuits 21 and 22 determine not to finish image display (NO at Step S24), the processing returns to Step S16. Therefore, the signal processing circuits 21 and 22 repeat the processing for deciding the extension coefficient $\alpha_A$ according to the input signal (the image), generating the output signal based on the extension coefficient $\alpha_A$, and adjusting the light amount of the planar light-source device 50 according to the signal extension, until image display is finished. When the signal processing circuits 21 and 22 determine to finish image display (YES at Step S24), this processing is finished.

The display device 10 can obtain the advantages described above by performing the above processing. Even in a case where the display device 10 includes a fourth sub-pixel, the display device 10 can also include a mode of displaying an image without using the fourth sub-pixel.

According to the embodiment, the signal processing circuits 21 and 22 can decide the extension coefficient $\alpha_A$ and perform the extension processing in a cooperative manner. Therefore, the display device 10 can respond to the increase in resolution of the image display panel 30, even in a case where there is a constraint on the number of pins in a semiconductor chip.

The signal processing circuits 21 and 22 have the same circuit configuration. That is, the signal processing circuits 21 and 22 can be manufactured using the same mask through the same manufacturing steps. Therefore, the display device 10 can reduce design costs and manufacturing costs as compared to the case where a master signal processing circuit and a slave signal processing circuit are separately designed and manufactured.

The α-aggregation unit 223 in the signal processing circuit 22 operates when the signal processing circuit 22 operates as a master, but does not operate when the signal processing circuit 22 operates as a slave. At this time, by shutting off power supply to the α-aggregation unit 223, the display device 10 can reduce power consumption.

The signal processing circuit 21 decides the extension coefficient $\alpha_A$ based on the extension coefficient $\alpha_1$ and the extension coefficient $\alpha_2$. The signal processing circuit 21 can decide a smaller one of the extension coefficient $\alpha_1$ and the extension coefficient $\alpha_2$ as the extension coefficient $\alpha_A$, for example. Therefore, the display device 10 can suppress reduction in display quality.

The signal processing circuit 21 can decide a larger one of the extension coefficient $\alpha_1$ and the extension coefficient $\alpha_2$ as the extension coefficient $\alpha_A$, for example. Therefore, the display device 10 can further decrease the luminance of the planar light-source device 50, and accordingly reduce power consumption.

The signal processing circuit 21 can decide a value between the extension coefficient $\alpha_1$ and the extension coefficient $\alpha_2$, that is, for example, an average value of the extension coefficient $\alpha_1$ and the extension coefficient $\alpha_2$, as the extension coefficient $\alpha_A$. Therefore, the display device 10 can balance reduction in power consumption with suppressing reduction in display quality.

First Modification

In the above embodiment, a case where one signal processing circuit that operates as a master and one signal processing circuit that operates as a slave are coupled has been explained. However, one signal processing circuit that operates as a master and two or more signal processing circuits that operate as a slave can also be coupled.

Figure 14:
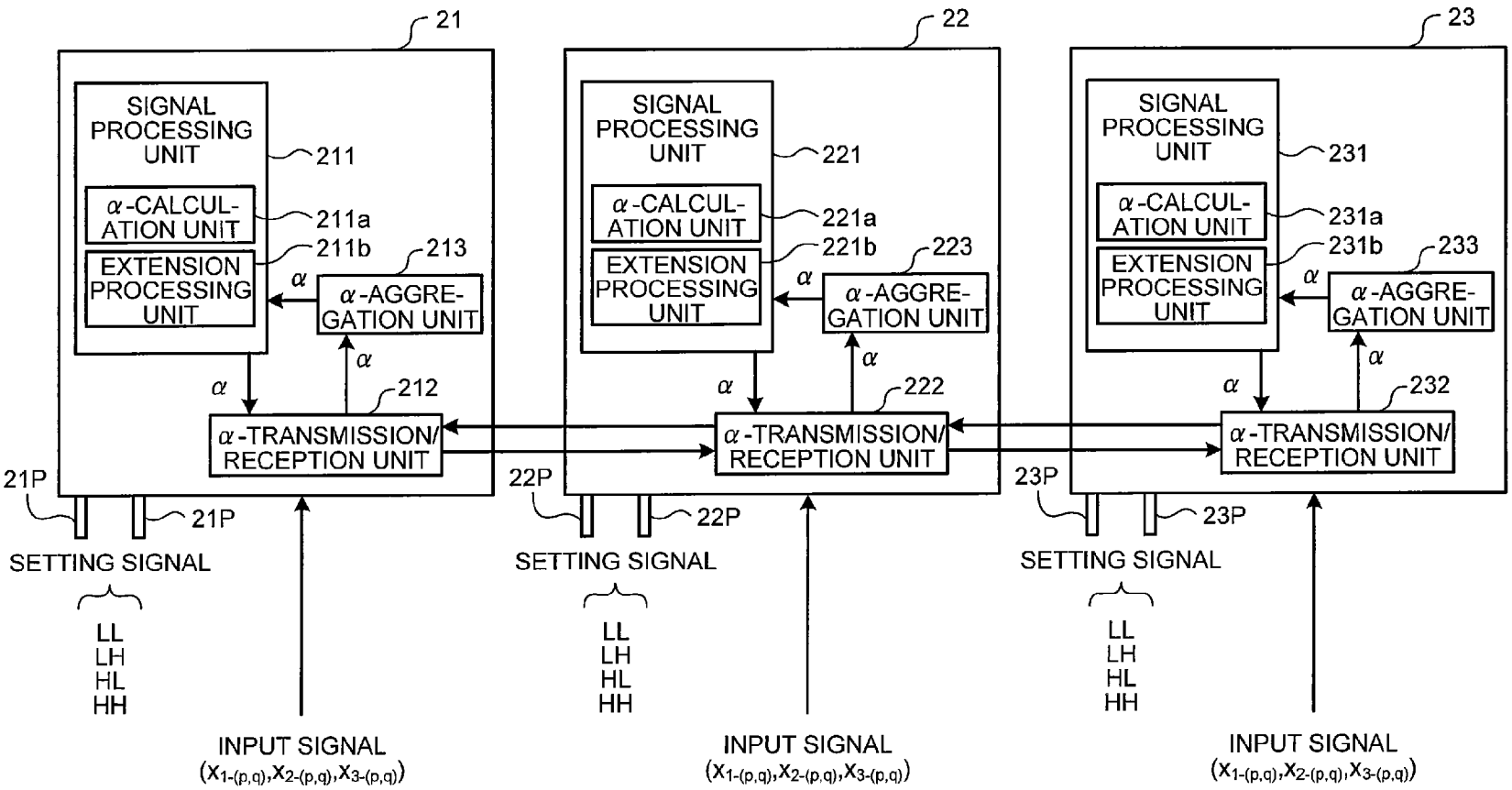
FIG. 14 illustrates coupling between one signal processing circuit that operates as a master and two signal processing circuits that operate as slaves.

FIG. 14 illustrates coupling between one signal processing circuit that operates as a master and two signal processing circuits that operate as slaves. In an example illustrated in FIG. 14, a signal processing circuit 23 is further coupled to the signal processing circuits 21 and 22.

The signal processing circuits 21, 22, and 23 can be coupled in a daisy chain, or can be coupled by a common bus.

The signal processing circuit 21 is responsible for the processing of a first region on the left side of plural pixels 48 in the image display panel 30, where in the first region, the number of pixels 48 is $J \times Q_0$ (the number of pixels 48 in the horizontal direction is J (where $1 \leq J < P_0 - 1$) and the number of pixels 48 in the vertical direction is $Q_0$). The signal processing circuit 22 is responsible for the processing of a second region at the center of plural pixels 48 in the image display panel 30, where in the second region, the number of pixels 48 is $K \times Q_0$ (the number of pixels 48 in the horizontal direction is K (where $1 \leq K < P_0 - 1$) and the number of pixels 48 in the vertical direction is $Q_0$). The signal processing circuit 23 is responsible for the processing of a third region on the right side of plural pixels 48 in the image display panel 30, where in the third region, the number of pixels 48 is $(P_0-(J+K)) \times Q_0$ (the number of pixels 48 in the horizontal direction is $(P_0-(J+K))$ (where $1 \leq J < P_0 - 1$, $1 \leq K < P_0 - 1$, and $J+K < P_0 - 1$), and the number of pixels 48 in the vertical direction is $Q_0$).

The signal processing circuit 23 includes a signal processing unit 231, an α-transmission/reception unit 232, and an α-aggregation unit 233. The signal processing unit 231 includes an α-calculation unit 231*a* and an extension processing unit 231*b*.

As described above, the signal processing circuit 23 has the same circuit configuration as the signal processing circuits 21 and 22. That is, the signal processing circuits 21, 22, and 23 are manufactured using the same mask through the same manufacturing steps. In the present modification, the signal processing circuit 21 operates as a master of the signal processing circuits 22 and 23, and the signal processing circuits 22 and 23 operate as a slave of the signal processing circuit 21. Whether the signal processing circuits 21, 22, and 23 operate as a master or a slave is set by a setting signal with at least a 1-bit width (a 2-bit width in the present modification), which is input to the signal processing circuits 21, 22, and 23.

The signal processing circuit 21 includes at least one (two in the present modification) setting-signal input terminal (input pin) 21P. The signal processing circuit 22 includes at least one (two in the present modification) setting-signal input terminal (input pin) 22P. The signal processing circuit 23 includes at least one (two in the present modification) setting-signal input terminal (input pin) 23P. The signal processing circuits 21, 22, and 23 operate as a master when an "LL (L means low level)" setting signal is input, operate as a first slave when an "LH (H means high level)" setting signal is input, operate as a second slave when an "HL" setting signal is input, and operate as a third slave when an "HH" setting signal is input. In a case where the setting signal has an n-bit width (n is a natural number), the display device 10 can include slaves, where the number of the slaves is up to $(2^n-1)$.

As described above, the signal processing circuits 21, 22, and 23 have the same circuit configuration, and therefore can reduce design costs and manufacturing costs as compared to the case where a master signal processing circuit and a slave signal processing circuit are separately designed and manufactured.

A low-level signal can be input to the signal processing circuits 21, 22, and 23 by coupling a ground (GND) line and the setting-signal input terminals 21P, 22P, and 23P. A high-level signal can be input to the signal processing circuits 21, 22, and 23 by coupling a power supply (VDD) line and the setting-signal input terminals 21P, 22P, and 23P. Therefore, the signal processing circuits 21, 22, and 23 can set an operating mode easily and reliably.

In the present modification, each of the signal processing circuits 21, 22, and 23 includes a setting-signal input terminal to input a setting signal to the setting-signal input terminal. However, each of the signal processing circuits 21, 22, and 23 can have a mode-setting register incorporated therein, and can operate as a master or a slave according to a setting signal (a mode value) input (written) to the register from an external application processor when initialization processing is performed at the time of power-on. Therefore, the operating mode of the signal processing circuits 21, 22, and 23 can be set by software, and can flexibly respond to changes in the specifications and the like.

The α-calculation unit 211*a* in the signal processing circuit 21 calculates the extension coefficient $\alpha_1$ for the first region. The α-calculation unit 211*a* also calculates $1/\alpha_1$. The extension-coefficient calculation processing is performed in the manner as described above.

The α-calculation unit 221*a* in the signal processing circuit 22 calculates the extension coefficient $\alpha_2$ for the second region. The α-calculation unit 221*a* also calculates $1/\alpha_2$.

The α-calculation unit 231*a* in the signal processing circuit 23 calculates an extension coefficient $\alpha_3$ for the third region. The α-calculation unit 231*a* also calculates $1/\alpha_3$.

The α-transmission/reception unit 222 in the signal processing circuit 22 transmits the extension coefficient $\alpha_2$ calculated by the α-calculation unit 221*a* to the α-transmission/reception unit 212 in the signal processing circuit 21. The α-transmission/reception unit 222 can also transmit $1/\alpha_2$ calculated by the α-calculation unit 221*a* to the α-transmission/reception unit 212. Because a high processing load is required to compute $1/\alpha_2$ (reciprocal computation), the α-transmission/reception unit 222 transmits $1/\alpha_2$ calculated by the α-calculation unit 221*a* to the α-transmission/reception unit 212, and therefore a processing load imposed on the signal processing circuit 21 can be reduced. This is more effective when the number of signal processing circuits that operate as a slave increases.

The α-transmission/reception unit 232 in the signal processing circuit 23 transmits the extension coefficient $\alpha_3$ calculated by the α-calculation unit 231*a* to the α-transmission/reception unit 212 in the signal processing circuit 21. The α-transmission/reception unit 232 can also transmit $1/\alpha_3$ calculated by the α-calculation unit 231*a* to the α-transmission/reception unit 212. Because a high processing load is required to compute $1/\alpha_3$ (reciprocal computation), the α-transmission/reception unit 232 transmits $1/\alpha_3$ calculated by the α-calculation unit 231*a* to the α-transmission/reception unit 212, and therefore a processing load imposed on the signal processing circuit 21 can be reduced.

Assuming that the bit width of the extension coefficient $\alpha_2$ is 10 bits, and the bit width of $1/\alpha_2$ is 10 bits, the data amount to be transmitted from the signal processing circuit 22 to the signal processing circuit 21 is 20 bits, which is very small.

Assuming that the bit width of the extension coefficient $\alpha_3$ is 10 bits, and the bit width of $1/\alpha_3$ is 10 bits, the data amount to be transmitted from the signal processing circuit 23 to the signal processing circuit 21 is 20 bits, which is very small.

In a case where there are two signal processing circuits that operate as a slave, the bus cycle from the time $t_1$ to the time $t_{11}$ illustrated in FIG. 12 is performed by the number of slaves as explained in the above embodiment, that is, twice in the present modification.

The α-aggregation unit 213 in the signal processing circuit 21 aggregates the extension coefficient $\alpha_1$ calculated by the α-calculation unit 211*a*, and the extension coefficients $\alpha_2$ and $\alpha_3$ received by the α-transmission/reception unit 212 to decide the extension coefficient $\alpha_A$ of the image display panel 30 in its entirety. The α-aggregation unit 213 also decides $1/\alpha_A$.

The α-aggregation unit 213 can decide a smallest one of the extension coefficients $\alpha_1$, $\alpha_2$, and $\alpha_3$ as the extension coefficient $\alpha_A$, for example. Therefore, the display device 10 can suppress reduction in display quality.

The α-aggregation unit 213 can decide a largest one of the extension coefficients $\alpha_1$, $\alpha_2$, and $\alpha_3$ as the extension coefficient $\alpha_A$, for example. Therefore, the display device 10 can further decrease the luminance of the planar light-source device 50, and accordingly reduce power consumption.

The α-aggregation unit 213 can also decide a value between the smallest one of the extension coefficients $\alpha_1$, $\alpha_2$, and $\alpha_3$ and the largest one of the extension coefficients $\alpha_1$, $\alpha_2$, and $\alpha_3$, that is, for example, an average value of the extension coefficients $\alpha_1$, $\alpha_2$, and $\alpha_3$, as the extension coefficient $\alpha_A$. Therefore, the display device 10 can balance reduction in power consumption with suppressing reduction in display quality.

The α-aggregation unit 213 can decide a median of the extension coefficients $\alpha_1$, $\alpha_2$, and $\alpha_3$ as the extension coefficient $\alpha_A$. Therefore, the display device 10 can balance reduction in power consumption with suppressing reduction in display quality.

The α-aggregation unit 213 can calculate a weighted average value of the extension coefficient $\alpha_2$, which is given a large weight, and the extension coefficients $\alpha_1$ and $\alpha_3$, which are given a small weight, and decide the weighted average value as the extension coefficient $\alpha_A$. Therefore, the display device 10 can balance reduction in power consumption with suppressing reduction in display quality at the central portion of the image display panel 30, where the central portion exerts a large influence on an image viewer.

The α-transmission/reception unit 212 in the signal processing circuit 21 transmits the extension coefficient $\alpha_A$ and its inverse $1/\alpha_A$ decided by the α-aggregation unit 213 to the α-transmission/reception unit 222 in the signal processing unit 22 and to the α-transmission/reception unit 232 in the signal processing unit 23. The α-transmission/reception unit 222 outputs the received extension coefficient $\alpha_A$ and the received inverse $1/\alpha_A$ to the extension processing unit 221*b*. The α-transmission/reception unit 232 outputs the received extension coefficient $\alpha_A$ and the received inverse $1/\alpha_A$ to the extension processing unit 231*b*.

Even in a case where there are two signal processing circuits that operate as a slave, the bus cycle from the time $t_{12}$ to the time $t_2$ illustrated in FIG. 12 is performed only once as explained in the above embodiment.

Assuming that the bit width of the extension coefficient $\alpha_A$ is 10 bits, and the bit width of $1/\alpha_A$ is 10 bits, the data amount to be transmitted from the α-transmission/reception unit 212 in the signal processing circuit 21 to the α-transmission/reception unit 222 in the signal processing circuit 22 and to the α-transmission/reception unit 232 in the signal processing circuit 23 is 20 bits, which is very small.

The extension processing unit 211*b* in the signal processing circuit 21 uses the extension coefficient $\alpha_A$ decided by the α-aggregation unit 213 to perform the extension processing on the first region. The extension processing unit 221*b* in the signal processing circuit 22 uses the extension coefficient $\alpha_A$ received by the α-transmission/reception unit 222 to perform the extension processing on the second region. The extension processing unit 231*b* in the signal processing circuit 23 uses the extension coefficient $\alpha_A$ received by the α-transmission/reception unit 232 to perform the extension processing on the third region. The extension processing is performed in the manner as described above.

The α-aggregation unit 223 in the signal processing unit 22 and the α-aggregation unit 233 in the signal processing unit 23 operate when the signal processing circuits 22 and 23 operate as a master, but do not operate when the signal processing circuits 22 and 23 operate as a slave. At this time, shutting-off power supply to the α-aggregation units 223 and 233 can reduce power consumption.

According to the present modification, the signal processing circuits 21, 22, and 23 can decide the extension coefficient $\alpha_A$ and perform the extension processing in a cooperative manner. Therefore, the display device 10 can respond to the increase in resolution of the image display panel 30, even in a case where there is a constraint on the number of pins in a semiconductor chip.

The signal processing circuits 21, 22, and 23 have the same circuit configuration. That is, the signal processing circuits 21, 22, and 23 can be manufactured using the same mask through the same manufacturing steps. Therefore, the display device 10 can reduce design costs and manufacturing costs as compared to the case where a master signal processing circuit and a slave signal processing circuit are separately designed and manufactured.

The α-aggregation unit 223 in the signal processing unit 22 and the α-aggregation unit 233 in the signal processing unit 23 operate when the signal processing circuits 22 and 23 operate as a master, but do not operate when the signal processing circuits 22 and 23 operate as slave. At this time, by shutting-off power supply to the α-aggregation units 223 and 233, the display device 10 can reduce power consumption.

The signal processing circuit 21 decides the extension coefficient $\alpha_A$ based on the extension coefficients $\alpha_1$, $\alpha_2$, and $\alpha_3$. The signal processing circuit 21 can decide a smallest one of the extension coefficients $\alpha_1$, $\alpha_2$, and $\alpha_3$ as the extension coefficient $\alpha_A$, for example. Therefore, the display device 10 can suppress reduction in display quality.

The signal processing circuit 21 can decide a largest one of the extension coefficients $\alpha_1$, $\alpha_2$, and $\alpha_3$ as the extension coefficient $\alpha_A$, for example. Therefore, the display device 10 can further decrease the luminance of the planar light-source device 50, and accordingly reduce power consumption.

The signal processing circuit 21 can also decide a value between the smallest one of the extension coefficients $\alpha_1$, $\alpha_2$, and $\alpha_3$ and the largest one of the extension coefficients $\alpha_1$, $\alpha_2$, and $\alpha_3$, that is, for example, an average value of the extension coefficients $\alpha_1$, $\alpha_2$, and $\alpha_3$, as the extension coefficient $\alpha_A$. Therefore, the display device 10 can balance reduction in power consumption with suppressing reduction in display quality.

The signal processing circuit 21 can decide a median of the extension coefficients $\alpha_1$, $\alpha_2$, and $\alpha_3$ as the extension coefficient $\alpha_A$. Therefore, the display device 10 can balance reduction in power consumption with suppressing reduction in display quality.

The signal processing circuit 21 can calculate a weighted average value of the extension coefficient $\alpha_2$, which is given a large weight, and the extension coefficients $\alpha_1$ and $\alpha_3$, which are given a small weight, and decide the weighted average value as the extension coefficient $\alpha_A$. Therefore, the display device 10 can balance reduction in power consumption with suppressing reduction in display quality at the central portion of the image display panel 30, where the central portion exerts a large influence on an image viewer.

The α-aggregation unit 223 in the signal processing unit 22 and the α-aggregation unit 233 in the signal processing unit 23 operate when the signal processing circuits 22 and 23 operate as a master, but do not operate when the signal processing circuits 22 and 23 operate as a slave. At this time, by shutting-off power supply to the α-aggregation units 223 and 233, the display device 10 can reduce power consumption.

Second Modification

In the above embodiment, a case where the planar light-source device 50 is driven in its entirety has been explained. However, the planar light-source device 50 can be partially driven.

Figure 15:
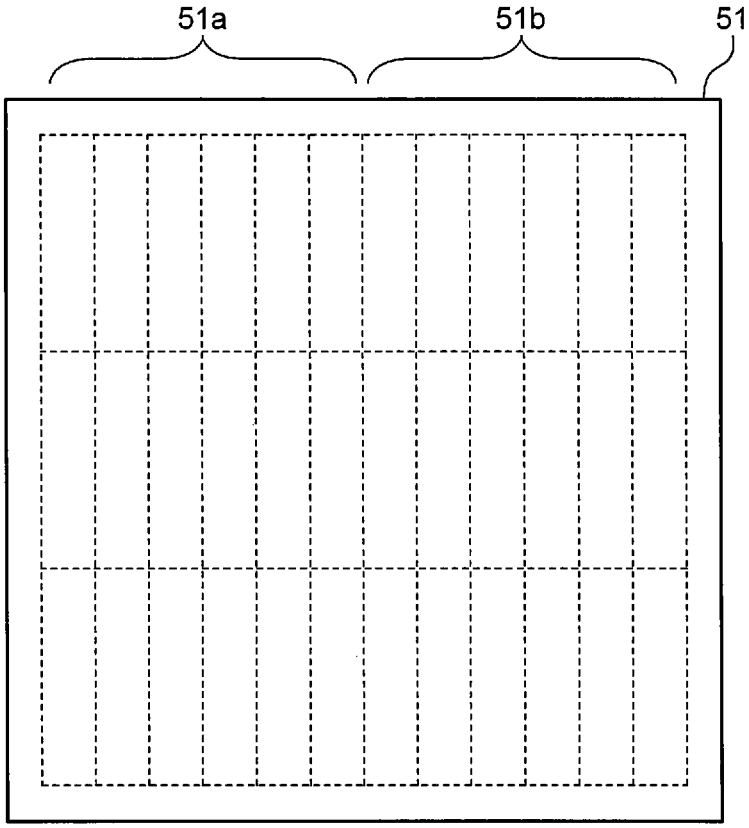
FIG. 15 is a plan view of a planar light-source device that can be partially driven.

FIG. 15 is a plan view of a planar light-source device that can be partially driven. As illustrated in FIG. 15, a planar light-source device 51 is partitioned by 12 blocks in the horizontal direction (the column direction) and by three blocks in the vertical direction (the row direction) into 36 blocks in total.

The signal processing circuit 21 is responsible for controlling a block group 51*a* on the left side of plural blocks in the planar light-source device 51 illustrated in FIG. 15, where in the block group 51*a*, the number of blocks is 6×3 (six blocks in the horizontal direction and three blocks in the vertical direction). The signal processing circuit 22 is responsible for controlling a block group 51*b* on the right side of plural blocks in the planar light-source device 51 in FIG. 15, where in the block group 51*b*, the number of blocks is 6×3 (six blocks in the horizontal direction and three blocks in the vertical direction).

In this case, the number of blocks for which each of the signal processing circuits 21 and 22 is responsible is 3×12 (LEDs)/2=18 (blocks).

Assuming that the extension coefficient $\alpha_2$ of each block has a 10-bit width, and $1/\alpha_2$ has a 10-bit width, the data amount to be transmitted from the signal processing circuit 22 that operates as a slave to the signal processing circuit 21 that operates as a master is 18 (blocks)×20 (bits)=360 (bits), which is small and can sufficiently withstand practical use.

Assuming that $1/\alpha_A$ has a 10-bit width, the data amount to be transmitted from the signal processing circuit 21 that operates as a master to the signal processing circuit 22 that operates as a slave is (6×2) (LEDs)×10 (bits)=120 (bits), which is small and can sufficiently withstand practical use.

According to the present modification, the signal processing circuits 21 and 22 are capable of partially driving the planar light-source device 51. Therefore, the signal processing circuits 21 and 22 are capable of controlling the light amount more precisely, and can suppress reduction in image display quality and achieve reduction in power consumption.

2. Application Example

Next, application examples of the display device according to the above embodiment and its modifications are explained below. It is possible to apply the display device according to the embodiment to electronic apparatuses in any field, including a portable phone, a portable terminal device such as a smartphone, a television device, a digital camera, a laptop personal computer, a video camera, meters provided in a vehicle, and the like. In other words, it is possible to apply the display device according to the present embodiment to electronic apparatuses in any field, which display a video signal input externally or a video signal generated internally as an image or a video. The electronic apparatuses include a control device that supplies a video signal to the display device to control an operation of the display device.

Application Example 1

Figure 16:
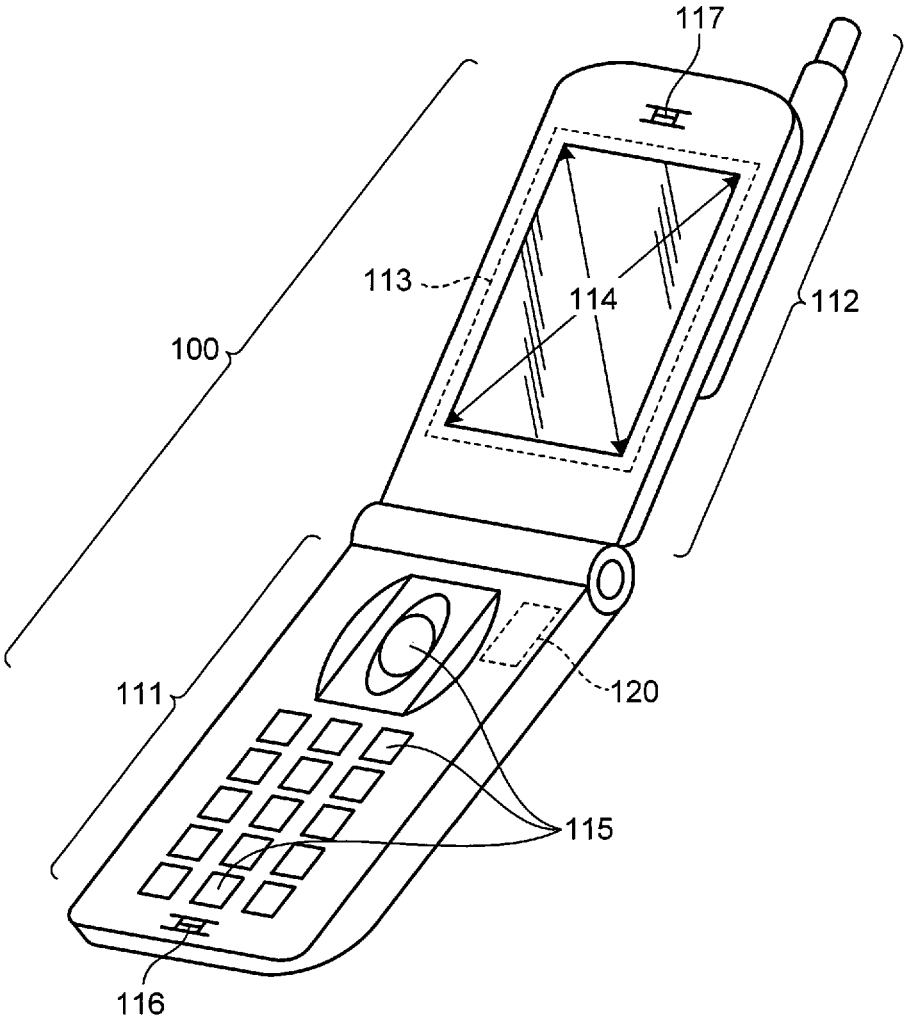
FIG. 16 is a perspective view of a configuration example of an electronic apparatus according to an application example 1.

FIG. 16 is a perspective view of a configuration example of an electronic apparatus according to an application example 1. An electronic apparatus 100 is a portable phone, and includes, for example, a main unit 111 and a display body 112 that is provided to be capable of being opened from and closed to the main unit 111 as illustrated in FIG. 16. The main unit 111 includes an operation button 115 and a transmitter 116. The electronic apparatus 100 has a control device 120 that is incorporated therein to control the electronic apparatus 100 in its entirety. The display body 112 includes a display device 113 and a receiver 117. The display device 113 performs various kinds of display regarding telephone communication on a display screen 114 of the display device 113. The electronic apparatus 100 includes a control unit (not illustrated) that controls an operation of the display device 113. This control unit is provided in the interior of the main unit 111 as a part of the control device 120, or is provided in the interior of the display body 112 separately from the control device 120. The control device 120 that controls the electronic apparatus 100 in its entirety supplies a video signal to the control unit of the display device 113. That is, the control device 120 decides a video to be displayed by the electronic apparatus 100, and transmits a video signal of the decided video to the control unit of the display device 113 to cause the display device 113 to display the decided video.

The display device 113 has the same configuration as the display device 10 according to the above embodiment and its modifications. Therefore, the display device 113 can achieve low power consumption, while suppressing reduction in display quality.

Examples of an electronic apparatus, to which the display device 10 according to the above embodiment and its modifications is applicable, include a clock with a display device, a watch with a display device, a personal computer, a liquid crystal television, a viewfinder-type or monitor direct-view-type videotape recorder, a car navigation device, a pager, an electronic organizer, a calculator, word processor, a workstation, a videophone, and a POS terminal device, in addition to the portable phone explained above.

Figure 17:
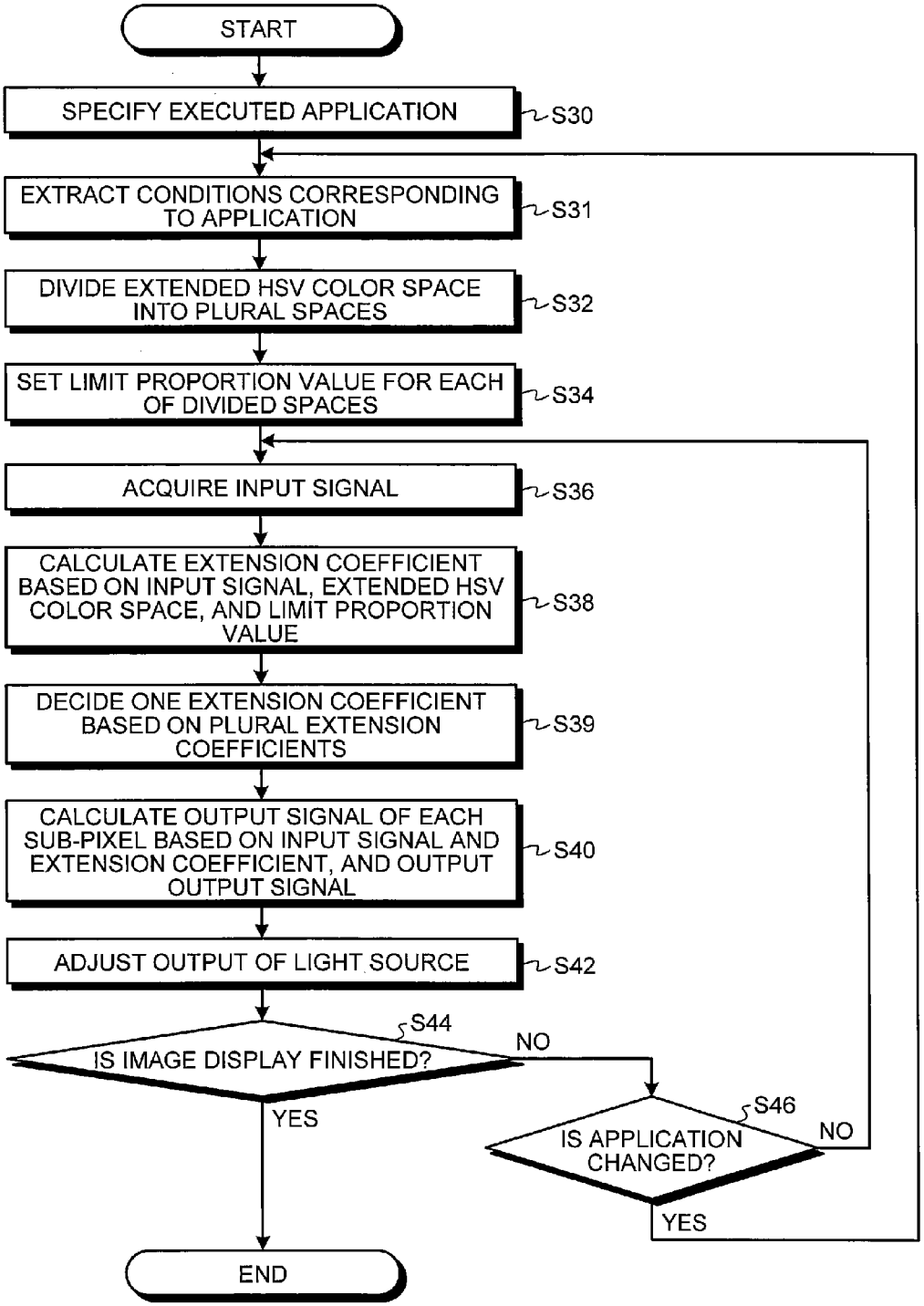
FIG. 17 is a flowchart illustrating an example of a control operation of the electronic apparatus.

The electronic apparatus 100 may change data (hereinafter, "conditions") that shows a rule for dividing an extended HSV color space into plural spaces and information regarding a limit proportion value set for each of the divided spaces according to an image-displaying application (software and function). FIG. 17 is a flowchart illustrating an example of a control operation of the electronic apparatus. The electronic apparatus 100 implements the processing illustrated in FIG. 17 by performing arithmetic processing mainly by the signal processing circuits 21 and 22 in the display device 113 and by the control device 120.

The control device 120 specifies an executed application (Step S30), and extracts conditions that correspond to the application (Step S31).

Next, the display device 113 divides an extended HSV color space into plural spaces (Step S32), and sets a limit proportion value for each of the divided spaces (Step S34). The display device 113 reads stored data to divide the color space and to set the limit proportion values.

After setting the limit proportion values, the display device 113 acquires an input signal (Step S36), and calculates an extension coefficient based on the acquired input signal, the extended HSV color space (a maximum value of brightness), and the limit proportion value (Step S38) set for a space according to the input signal. Specifically, the processing is performed through the above steps to obtain an extension coefficient such that a proportion of an extended output signal, which exceeds the extended HSV color space (the maximum value of brightness), with respect to the extended entire output signal, does not exceed the limit proportion value.

Next, the signal processing circuit 22 transmits the extension coefficient $\alpha_2$ to the signal processing circuit 21, and the signal processing circuit 21 decides one extension coefficient $\alpha_A$ based on plural extension coefficients $\alpha_1$ and $\alpha_2$ (Step S39).

The signal processing circuit 21 can decide a smaller one of the extension coefficient $\alpha_1$ and the extension coefficient $\alpha_2$ as the extension coefficient $\alpha_A$, for example. Therefore, the display device 113 can suppress reduction in display quality.

The signal processing circuit 21 can decide a larger one of the extension coefficient $\alpha_1$ and the extension coefficient $\alpha_2$ as the extension coefficient $\alpha_A$, for example. Therefore, the display device 113 can further decrease the luminance of the planar light-source device 50, and accordingly reduce power consumption.

The signal processing circuit 21 can decide a value between the extension coefficient $\alpha_1$ and the extension coefficient $\alpha_2$, that is, for example, an average value of the extension coefficient $\alpha_1$ and the extension coefficient $\alpha_2$, as the extension coefficient $\alpha_A$. Therefore, the display device 113 can balance reduction in power consumption with suppressing reduction in display quality.

Thereafter, the display device 113 calculates an output signal of each sub-pixel based on the input signal and the extension coefficient $\alpha_A$, outputs the output signal (Step S40), and further adjusts an output of a light source (Step S42). After adjusting the output of the light source, the display device 113 determines whether image display is finished (Step S44). When the electronic apparatus 100 determines not to finish image display (NO at Step S44), the display device 113 and the control device 120 determine whether the application is changed (Step S46). When the control device 120 determines that the application is changed (YES at Step S46), the processing returns to Step S31 to change the conditions. When the control device 120 determines that the application is not changed (NO at Step S46), the processing returns to Step S36. Therefore, the electronic apparatus 100 repeats the processing for deciding an extension coefficient according to an input signal (an image), generating an output signal based on the extension coefficient, and adjusting the light amount of a planar light-source device according to the signal extension, until image display is finished. When the application is changed, the electronic apparatus 100 can extend the input signal based on the conditions of a changed application. When the electronic apparatus 100 determines to finish image display (YES at Step S44), this processing is finished.

The electronic apparatus 100 can obtain the advantages described above by performing the above processing. The electronic apparatus 100 changes the conditions according to the change of the application, and therefore can increase the extension coefficient when display quality degradation is allowed, and can decrease the extension coefficient when high display quality is required, for example. This can satisfy the intended use of the electronic apparatus 100, and further can maintain the display quality and reduce power consumption.

Application Example 2

Figure 18:
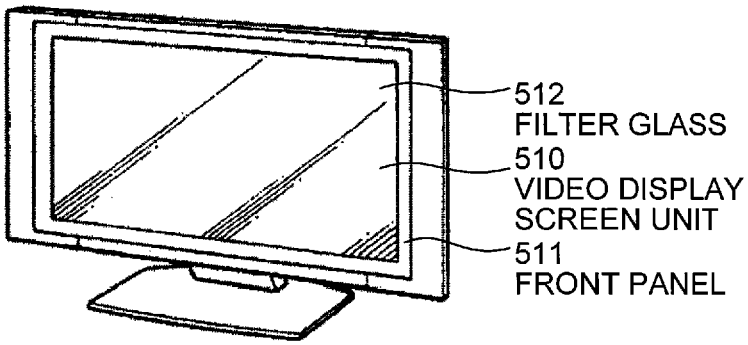
FIG. 18 illustrates a television device to which the display device according to the embodiment is applied.

FIG. 18 illustrates a television device to which the display device according to the embodiment is applied. This television device includes a video display screen unit 510 that includes a front panel 511 and a filter, glass 512, for example. The video display screen unit 510 is the display device according to the embodiment.

Application Example 3

Figure 19:
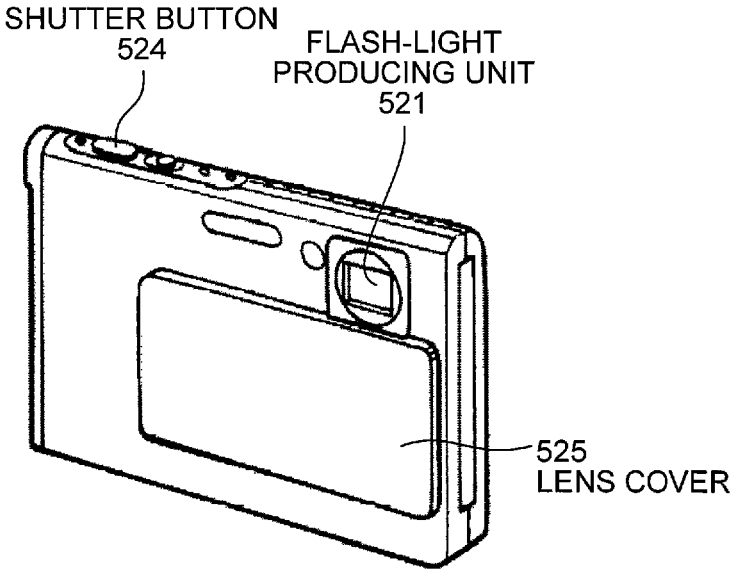
FIG. 19 illustrates a digital camera to which the display device according to the embodiment is applied.
Figure 20:
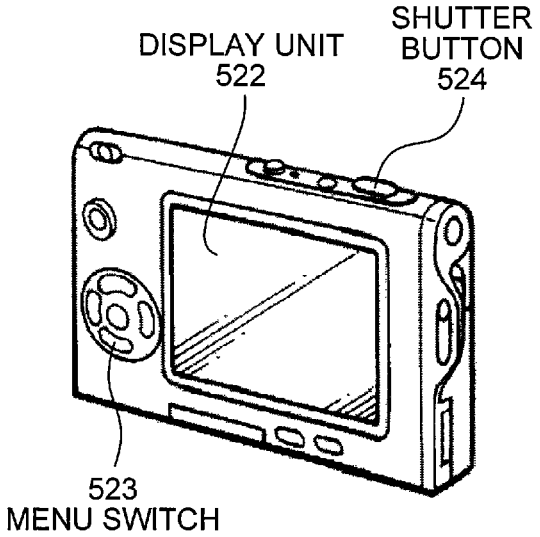
FIG. 20 illustrates a digital camera to which the display device according to the embodiment is applied.

FIGS. 19 and 20 illustrate a digital camera to which the display device according to the embodiment is applied. This digital camera includes a flash-light producing unit 521, a display unit 522, a menu switch 523, and a shutter button 524, for example. The display unit 522 is the display device according to the embodiment. As illustrated in FIG. 19, the digital camera includes a lens cover 525, and can slide the lens cover 525 to expose an image-capturing lens. A digital camera can image light incident from its image-capturing lens to capture a digital photograph.

Application Example 4

Figure 21:
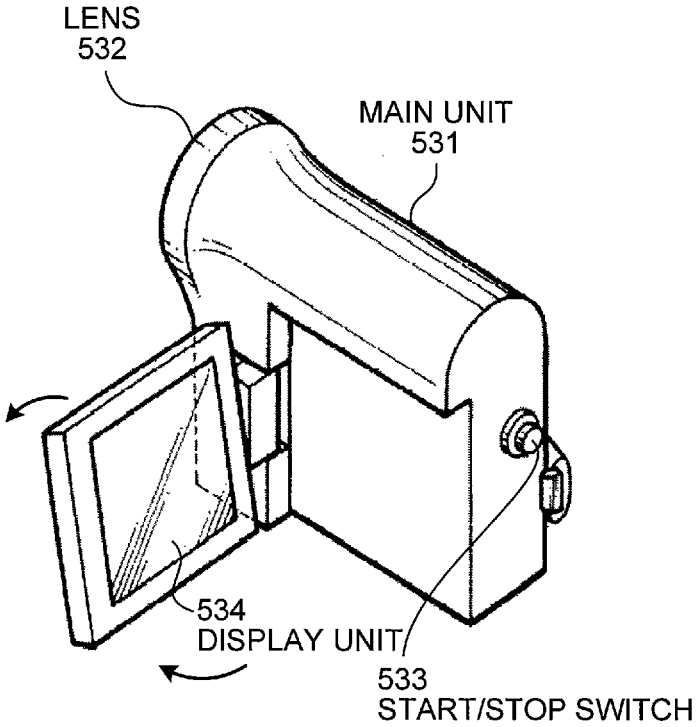
FIG. 21 illustrates an external appearance of a video camera to which the display device according to the embodiment is applied.

FIG. 21 illustrates the external appearance of a video camera to which the display device according to the embodiment is applied. This video camera includes a main unit 531, a subject capturing lens 532 that is provided on the front side of the main unit 531, an image-capturing start/stop switch 533, and a display unit 534, for example. The display unit 534 is the display device according to the embodiment.

Application Example 5

Figure 22:
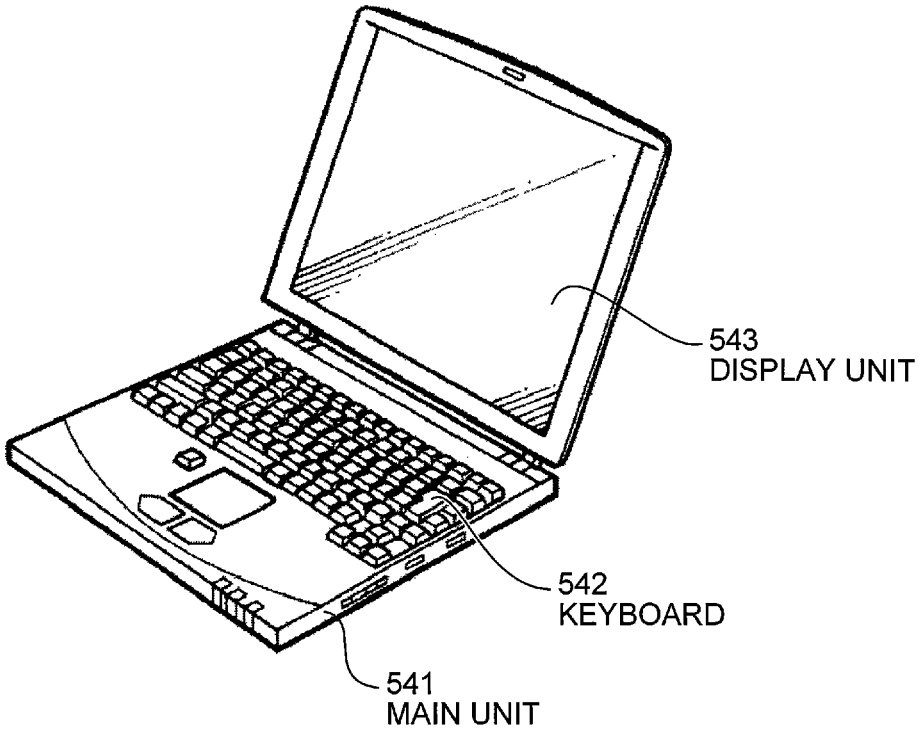
FIG. 22 illustrates a laptop personal computer to which the display device according to the embodiment is applied.

FIG. 22 illustrates a laptop personal computer to which the display device according to the embodiment is applied. This laptop personal computer includes a main unit 541, a keyboard 542 for an operation to input text and the like, and a display unit 543 that displays an image. The display unit 543 is configured by the display device according to the present embodiment.

Application Example 6

Figure 23:
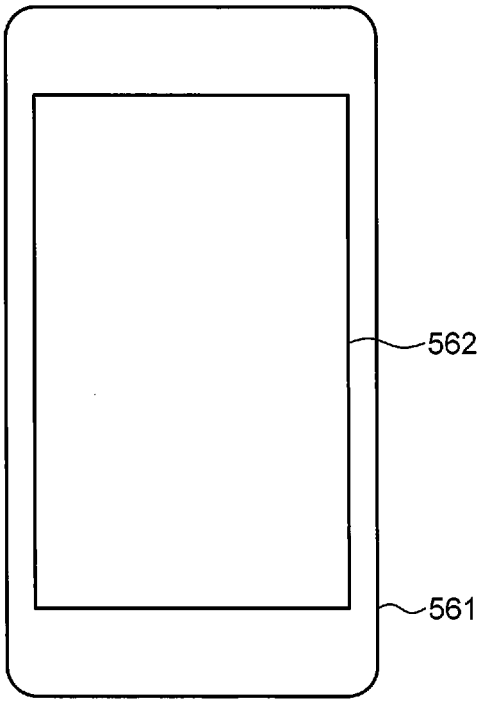
FIG. 23 illustrates a portable information terminal to which the display device according to the embodiment is applied.

FIG. 23 illustrates a portable information terminal that operates as a portable computer, a multi-functional portable phone, a portable computer capable of making a voice call, or a portable computer capable of other forms of communication, and that is also referred to as "smartphone" or "tablet terminal". This portable information terminal includes a display unit 562 on a surface of a casing 561, for example. The display unit 562 is the display device according to the embodiment.

3. Aspects of the Present Disclosure

The present disclosure includes the following aspects.

(1) A display device comprising:

an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color; and a plurality of signal processing circuits that are responsible for respective regions in the image display panel, that convert an input value of an input HSV color space of an input signal to each of their own responsible regions into an extension value of an extended HSV color space that is extended by the first color, the second color, the third color, and the fourth color to generate an output signal of the extension value, and that output the generated output signal to the image display panel, wherein the signal processing circuits decide an extension coefficient $\alpha_A$ for the image display panel in its entirety in a cooperative manner, and the signal processing circuit, regarding its own responsible region, calculates an output signal of the first sub-pixel based on at least an input signal of the first sub-pixel and the extension coefficient $\alpha_A$, and outputs the output signal to the first sub-pixel, calculates an output signal of the second sub-pixel based on at least an input signal of the second sub-pixel and the extension coefficient $\alpha_A$, and outputs the output signal to the second sub-pixel, calculates an output signal of the third sub-pixel based on at least an input signal of the third sub-pixel and the extension coefficient $\alpha_A$, and outputs the output signal to the third sub-pixel, and calculates an output signal of the fourth sub-pixel based on the input signal of the first sub-pixel, the input signal of the second sub-pixel, and the input signal of the third sub-pixel, and outputs the output signal to the fourth sub-pixel.

(2). The display device according to (1), wherein one of the signal processing circuits operates as a master of other ones of the signal processing circuits, the other ones of the signal processing circuits operate as a slave of the signal processing circuit that operates as a master, each of the signal processing circuits calculates an extension coefficient for an input signal to its own responsible region, the signal processing circuit that operates as a slave transmits an extension coefficient calculated on its own to the signal processing circuit that operates as a master, and the signal processing circuit that operates as a master decides the extension coefficient $\alpha_A$ based on an extension coefficient calculated on its own and an extension coefficient received from the signal processing circuit that operates as a slave, and transmits the extension coefficient $\alpha_A$ to the signal processing circuit that operates as a slave.

(3). The display device according to (2), wherein the signal processing circuits are semiconductor integrated circuits having a same circuit configuration, and operate as a master or a slave according to an externally-input setting signal.

(4). The display device according to (2), wherein the signal processing circuit that operates as a master decides a smallest one of a plurality of extension coefficients calculated respectively by the signal processing circuits as the extension coefficient $\alpha_A$.

(5). The display device according to (3), wherein the signal processing circuit includes a calculation unit that calculates an extension coefficient for an input signal to its own responsible region, an extension processing unit that calculates the output signal based on an input signal to its own responsible region and the extension coefficient $\alpha_A$, a transmission/reception unit that transmits an extension coefficient calculated on its own to the signal processing circuit that operates as a master, and that receives the extension coefficient $\alpha_A$ from the signal processing circuit that operates as a master, and an aggregation unit that decides the extension coefficient $\alpha_A$ based on an extension coefficient calculated on its own and an extension coefficient received from the signal processing circuit that operates as a slave.

(6). The display device according to (5), wherein power supply to the aggregation unit in the signal processing circuit that operates as a slave is shut off and the aggregation unit does not operate.

(7). The display device according to (2), wherein the signal processing circuit that operates as a slave transmits an inverse of an extension coefficient calculated on its own to the signal processing circuit that operates as a master, and the signal processing circuit that operates as a master transmits an inverse of the extension coefficient $\alpha_A$ to the signal processing circuit that operates as a slave.

(8). The display device according to (2), further comprising a light-source device that illuminates the image display panel, wherein the signal processing circuit that operates as a master controls luminance of the light-source device based on at least the extension coefficient $\alpha_A$.

(9). The display device according to (2), further comprising a light-source device that includes a plurality of blocks and illuminates the image display panel, wherein each of the signal processing circuits controls the block that illuminates its own responsible region of the light-source device that illuminates the image display panel.

(10). The display device according to (1), wherein the calculation unit sets a limit proportion value for the extended HSV color space, the limit proportion value being an upper limit of a proportion of a range that exceeds a maximum value of brightness in the extended HSV color space in a combination of hue and saturation values to the maximum value, and the calculation unit calculates an extension coefficient for the input signal within a range where a value exceeding the maximum value of brightness, among values obtained by performing multiplication brightness of on each sub-pixel signal in the input signal by the extension coefficient $\alpha_A$, does not exceed a value obtained by multiplying the maximum value of brightness by the limit proportion value.

(11). The display device according to (10), wherein the calculation unit divides the extended HSV color space into a plurality of spaces by at least one of saturation, brightness, and hue, and sets different values for at least two of the divided spaces as a limit proportion value that is an upper limit of a proportion of a range that exceeds a maximum value of brightness in the extended HSV color space in a combination of hue and saturation values to the maximum value.

(12). The display device according to (11), wherein the calculation unit divides the extended HSV color space into two or more spaces based on the saturation as a reference.

(13). The display device according to (11), wherein the calculation unit divides the extended HSV color space into two or more spaces based on the hue as a reference.

(14). The display device according to (11), wherein the calculation unit divides the extended HSV color space into two or more spaces based on the brightness as a reference.

(15). The display device according to (1), wherein the fourth color is white.

(16). An electronic apparatus comprising:

the display device according to (1); and a control device that supplies the input signal to the display device.

(17). A driving method of a display device that includes an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color, and a plurality of signal processing circuits that are responsible for respective regions in the image display panel, that convert an input value of an input HSV color space of an input signal to each of their own responsible regions into an extension value of an extended HSV color space that is extended by the first color, the second color, the third color, and the fourth color to generate an output signal of the extension value, and that output the generated output signal to the image display panel, the driving method comprising:

deciding an extension coefficient $\alpha_A$ for the image display panel in its entirety by the signal processing circuits in a cooperative manner; and by the signal processing circuit, regarding its own responsible region, calculating an output signal of the first sub-pixel based on at least an input signal of the first sub-pixel and the extension coefficient $\alpha_A$, and outputting the output signal to the first sub-pixel, calculating an output signal of the second sub-pixel based on at least an input signal of the second sub-pixel and the extension coefficient $\alpha_A$, and outputting the output signal to the second sub-pixel, calculating an output signal of the third sub-pixel based on at least an input signal of the third sub-pixel and the extension coefficient $\alpha_A$, and outputting the output signal to the third sub-pixel, and calculating an output signal of the fourth sub-pixel based on the input signal of the first sub-pixel, the input signal of the second sub-pixel, and the input signal of the third sub-pixel, and outputting the output signal to the fourth sub-pixel.

(18). A signal processing method in a display device that includes an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color, and a plurality of signal processing circuits that are responsible for respective regions in the image display panel, that convert an input value of an input HSV color space of an input signal to each of their own responsible regions into an extension value of an extended HSV color space that is extended by the first color, the second color, the third color, and the fourth color to generate an output signal of the extension value, and that output the generated output signal to the image display panel, the signal processing method being executed by the signal processing circuits, the signal processing method comprising:

deciding an extension coefficient $\alpha_A$ for the image display panel in its entirety by the signal processing circuits in a cooperative manner; and by the signal processing circuit, regarding its own responsible region, calculating an output signal of the first sub-pixel based on at least an input signal of the first sub-pixel and the extension coefficient $\alpha_A$, and outputting the output signal to the first sub-pixel, calculating an output signal of the second sub-pixel based on at least an input signal of the second sub-pixel and the extension coefficient $\alpha_A$, and outputting the output signal to the second sub-pixel, calculating an output signal of the third sub-pixel based on at least an input signal of the third sub-pixel and the extension coefficient $\alpha_A$, and outputting the output signal to the third sub-pixel, and calculating an output signal of the fourth sub-pixel based on the input signal of the first sub-pixel, the input signal of the second sub-pixel, and the input signal of the third sub-pixel, and outputting the output signal to the fourth sub-pixel.

(19). A signal processing circuit that is responsible for one of a plurality of regions in an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color, that converts an input value of an input HSV color space of an input signal to its own responsible region into an extension value of an extended HSV color space that is extended by the first color, the second color, the third color, and the fourth color to generate an output signal of the extension value, and that outputs the generated output signal to the image display panel, wherein the signal processing circuit decides an extension coefficient $\alpha_A$ for the image display panel in its entirety in a cooperative manner with other signal processing circuits that are responsible for other regions of the regions, and the signal processing circuit, regarding its own responsible region, calculates an output signal of the first sub-pixel based on at least an input signal of the first sub-pixel and the extension coefficient $\alpha_A$, and outputs the output signal to the first sub-pixel, calculates an output signal of the second sub-pixel based on at least an input signal of the second sub-pixel and the extension coefficient $\alpha_A$, and outputs the output signal to the second sub-pixel, calculates an output signal of the third sub-pixel based on at least an input signal of the third sub-pixel and the extension coefficient $\alpha_A$, and outputs the output signal to the third sub-pixel, and calculates an output signal of the fourth sub-pixel based on the input signal of the first sub-pixel, the input signal of the second sub-pixel, and the input signal of the third sub-pixel, and outputs the output signal to the fourth sub-pixel.

What is claimed is:

1. A display device comprising:

an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color; and a plurality of signal processing circuits that are responsible for respective regions in the image display panel, that convert an input value of an input HSV color space of an input signal to each of their own responsible regions into an extension value of an extended HSV color space that is extended by the first color, the second color, the third color, and the fourth color to generate an output signal of the extension value, and that output the generated output signal to the image display panel, wherein the signal processing circuits decide an extension coefficient $\alpha_A$ for the image display panel in its entirety in a cooperative manner, each of the signal processing circuits, regarding its own responsible region, calculates:

an output signal of the first sub-pixel based on at least an input signal of the first sub-pixel and the extension coefficient $\alpha_A$ to output the output signal to the first sub-pixel;

an output signal of the second sub-pixel based on at least an input signal of the second sub-pixel and the extension coefficient $\alpha_A$, to output the output signal to the second sub-pixel;

an output signal of the third sub-pixel based on at least an input signal of the third sub-pixel and the extension coefficient $\alpha_A$, to output the output signal to the third sub-pixel; and an output signal of the fourth sub-pixel based on the input signal of the first sub-pixel, the input signal of the second sub-pixel, and the input signal of the third sub-pixel, to output the output signal to the fourth sub-pixel, one of the signal processing circuits operates as a master of other ones of the signal processing circuits, the other ones of the signal processing circuits operate as a slave of the signal processing circuit that operates as a master, each of the signal processing circuits calculates an extension coefficient for an input signal to its own responsible region, each of the signal processing circuits that operate as a slave transmits an extension coefficient calculated on its own to the signal processing circuit that operates as a master, and the signal processing circuit that operates as a master decides the extension coefficient $\alpha_A$ based on an extension coefficient calculated on its own and an extension coefficient received from each of the signal processing circuits that operate as a slave, and transmits the extension coefficient $\alpha_A$ to each of the signal processing circuits that operate as a slave.

2. The display device according to claim 1, wherein the signal processing circuits are semiconductor integrated circuits having a same circuit configuration, and operate as a master or a slave according to an externally-input setting signal.

3. The display device according to claim 1, wherein the signal processing circuit that operates as a master decides a smallest one of a plurality of extension coefficients calculated respectively by the signal processing circuits as the extension coefficient $\alpha_A$.

4. The display device according to claim 2, wherein each of the signal processing circuit includes a calculation unit that calculates an extension coefficient for an input signal to its own responsible region, an extension processing unit that calculates the output signal based on an input signal to its own responsible region and the extension coefficient $\alpha_A$, a transmission/reception unit that transmits an extension coefficient calculated on its own to the signal processing circuit that operates as a master, and that receives the extension coefficient $\alpha_A$ from the signal processing circuit that operates as a master, and an aggregation unit that decides the extension coefficient $\alpha_A$ based on an extension coefficient calculated on its own and an extension coefficient received from each of the signal processing circuits that operate as a slave.

5. The display device according to claim 4, wherein power supply to the aggregation unit in each of the signal processing circuits that operate as a slave is shut off and the aggregation unit does not operate.

6. The display device according to claim 1, wherein each of the signal processing circuits that operate as a slave transmits an inverse of an extension coefficient calculated on its own to the signal processing circuit that operates as a master, and the signal processing circuit that operates as a master transmits an inverse of the extension coefficient $\alpha_A$ to each of the signal processing circuits that operate as a slave.

7. The display device according to claim 1, further comprising a light-source device that illuminates the image display panel, wherein the signal processing circuit that operates as a master controls luminance of the light-source device based on at least the extension coefficient $\alpha_A$.

8. The display device according to claim 1, further comprising a light-source device that includes a plurality of blocks and illuminates the image display panel, wherein each of the signal processing circuits controls the blocks that illuminate respective own responsible region of the light-source device that illuminates the image display panel.

9. The display device according to claim 1, wherein the calculation unit sets a limit proportion value for the extended HSV color space, the limit proportion value being an upper limit of a proportion of a range that exceeds a maximum value of brightness in the extended HSV color space in a combination of hue and saturation values to the maximum value, and the calculation unit calculates an extension coefficient for the input signal within a range where a value exceeding the maximum value of brightness, among values obtained by performing multiplication brightness of on each sub-pixel signal in the input signal by the extension coefficient $\alpha_A$, does not exceed a value obtained by multiplying the maximum value of brightness by the limit proportion value.

10. The display device according to claim 9, wherein the calculation unit divides the extended HSV color space into a plurality of spaces by at least one of saturation, brightness, and hue, and sets different values for at least two of the divided spaces as a limit proportion value that is an upper limit of a proportion of a range that exceeds a maximum value of brightness in the extended HSV color space in a combination of hue and saturation values to the maximum value.

11. The display device according to claim 10, wherein the calculation unit divides the extended HSV color space into two or more spaces based on the saturation as a reference.

12. The display device according to claim 10, wherein the calculation unit divides the extended HSV color space into two or more spaces based on the hue as a reference.

13. The display device according to claim 10, wherein the calculation unit divides the extended HSV color space into two or more spaces based on the brightness as a reference.

14. The display device according to claim 1, wherein the fourth color is white.

15. An electronic apparatus comprising:

the display device according to claim 1; and a control device that supplies the input signal to the display device.

16. A driving method of a display device that includes an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color, and a plurality of signal processing circuits that are responsible for respective regions in the image display panel, that convert an input value of an input HSV color space of an input signal to each of their own responsible regions into an extension value of an extended HSV color space that is extended by the first color, the second color, the third color, and the fourth color to generate an output signal of the extension value, and that output the generated output signal to the image display panel, the driving method comprising:

deciding an extension coefficient $\alpha_A$ for the image display panel in its entirety by the signal processing circuits in a cooperative manner; and by each of the signal processing circuits, regarding its own responsible region, calculating:

an output signal of the first sub-pixel based on at least an input signal of the first sub-pixel and the extension coefficient $\alpha_A$, to output the output signal to the first sub-pixel;

an output signal of the second sub-pixel based on at least an input signal of the second sub-pixel and the extension coefficient $\alpha_A$, to output the output signal to the second sub-pixel;

an output signal of the third sub-pixel based on at least an input signal of the third sub-pixel and the extension coefficient $\alpha_A$ to output the output signal to the third sub-pixel; and an output signal of the fourth sub-pixel based on the input signal of the first sub-pixel, the input signal of the second sub-pixel, and the input signal of the third sub-pixel to output the output signal to the fourth sub-pixel, wherein, when one of the signal processing circuits operates as a master of other ones of the signal processing circuits and the other ones of the signal processing circuits operate as a slave of the signal processing circuit that operates as a master, the driving method further includes:

calculating by each of the signal processing circuits an extension coefficient for an input signal to its own responsible region;

transmitting by each of the signal processing circuits that operate as a slave an extension coefficient calculated on its own to the signal processing circuit that operates as a master; and deciding by the signal processing circuit that operates as a master the extension coefficient $\alpha_A$ based on an extension coefficient calculated on its own and an extension coefficient received from each of the signal processing circuits that operate as a slave, and transmitting the extension coefficient $\alpha_A$ to each of the signal processing circuits that operate as a slave.

17. A signal processing method in a display device that includes an image display panel in which pixels are arrayed in a two-dimensional matrix, each of the pixels including a first sub-pixel that displays a first color, a second sub-pixel that displays a second color, a third sub-pixel that displays a third color, and a fourth sub-pixel that displays a fourth color, and a plurality of signal processing circuits that are responsible for respective regions in the image display panel, that convert an input value of an input HSV color space of an input signal to each of their own responsible regions into an extension value of an extended HSV color space that is extended by the first color, the second color, the third color, and the fourth color to generate an output signal of the extension value, and that output the generated output signal to the image display panel, the signal processing method being executed by the signal processing circuits, the signal processing method comprising:

deciding an extension coefficient $\alpha_A$ for the image display panel in its entirety by the signal processing circuits in a cooperative manner; and by each of the signal processing circuits, regarding its own responsible region, calculating:

an output signal of the first sub-pixel based on at least an input signal of the first sub-pixel and the extension coefficient $\alpha_A$ to output the output signal to the first sub-pixel;

an output signal of the second sub-pixel based on at least an input signal of the second sub-pixel and the extension coefficient $\alpha_A$ to output the output signal to the second sub-pixel;

an output signal of the third sub-pixel based on at least an input signal of the third sub-pixel and the extension coefficient $\alpha_A$ to output the output signal to the third sub-pixel; and an output signal of the fourth sub-pixel based on the input signal of the first sub-pixel, the input signal of the second sub-pixel, and the input signal of the third sub-pixel to output the output signal to the fourth sub-pixel, wherein, when one of the signal processing circuits operates as a master of other ones of the signal processing circuits and the other ones of the signal processing circuits operate as a slave of the signal processing circuit that operates as a master, the signal processing method further includes:

calculating by each of the signal processing circuits an extension coefficient for an input signal to its own responsible region;

transmitting by each of the signal processing circuits that operate as a slave an extension coefficient calculated on its own to the signal processing circuit that operates as a master; and deciding by the signal processing circuit that operates as a master the extension coefficient $\alpha_A$ based on an extension coefficient calculated on its own and an extension coefficient received from each of the signal processing circuits that operate as a slave, and transmitting the extension coefficient $\alpha_A$ to each of the signal processing circuits that operate as a slave.

* * * * *